US011027904B2

(12) United States Patent
McCree et al.

(10) Patent No.: US 11,027,904 B2
(45) Date of Patent: Jun. 8, 2021

(54) CARRIER FOR CONTAINERS

(71) Applicant: Graphic Packaging International, LLC, Atlanta, GA (US)

(72) Inventors: Justin McCree, Bristol (GB); Brian Smalley, Bristol (GB); Steve M. Gould, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 16/426,057

(22) Filed: May 30, 2019

(65) Prior Publication Data

US 2020/0189818 A1 Jun. 18, 2020

Related U.S. Application Data

(60) Provisional application No. 62/779,689, filed on Dec. 14, 2018, provisional application No. 62/783,752, filed on Dec. 21, 2018, provisional application No. 62/796,830, filed on Jan. 25, 2019, provisional application No. 62/797,585, filed on Jan. 28, 2019, provisional application No. 62/810,015, filed on Feb. 25, 2019, provisional application No. 62/814,412, filed on Mar. 6, 2019, provisional application No. 62/817,120, filed on Mar. 12, 2019, provisional application No. 62/841,449, filed on May 1, 2019.

(51) Int. Cl.
*B65D 71/42* (2006.01)
*B65D 75/04* (2006.01)

(52) U.S. Cl.
CPC ..... *B65D 71/42* (2013.01); *B65D 75/04* (2013.01)

(58) Field of Classification Search
CPC ..... B65D 71/12; B65D 71/42; B65D 71/44; B65D 75/00; B65D 75/04
USPC ..... 206/147, 151–155
See application file for complete search history.

(56) References Cited

U.S. PATENT DOCUMENTS

| | | | |
|---|---|---|---|
| 1,527,399 | A | 2/1925 | Davidson |
| 2,289,859 | A | 7/1942 | Arthur |
| 2,320,440 | A | 6/1943 | Kruea |
| 2,522,950 | A | 9/1950 | Keith |
| 2,737,326 | A | 3/1956 | Toensmeier |
| 2,798,603 | A | 7/1957 | Grinspoon |
| 2,950,041 | A | 8/1960 | Stone |

(Continued)

FOREIGN PATENT DOCUMENTS

| | | |
|---|---|---|
| CA | 2133827 | 10/1993 |
| DE | 10 2009 059 047 A1 | 6/2011 |

(Continued)

OTHER PUBLICATIONS

European Search Report for EP 19 18 0460 dated Jan. 13, 2020.

(Continued)

*Primary Examiner* — Bryon P Gehman
(74) *Attorney, Agent, or Firm* — Womble Bond Dickinson (US) LLP

(57) ABSTRACT

A carrier for holding a plurality of container includes a plurality of panels including at least one central panel and at least one attachment panel configured to receive a portion of one or more containers of the plurality of containers. The at least one central panel is for being positioned between and attached to adjacent containers of the plurality of containers.

57 Claims, 23 Drawing Sheets

(56) References Cited

U.S. PATENT DOCUMENTS 2,965,410 A 12/1960 Hughes
3,001,647 A 9/1961 Liss
3,061,141 A 10/1962 Cote
3,118,537 A 1/1964 Copping
3,137,109 A 6/1964 Rapata
3,200,944 A 8/1965 Rapata
3,245,711 A 4/1966 Dantoin
3,281,180 A 10/1966 Spery
3,302,784 A 2/1967 Copping
3,387,879 A 6/1968 Wood
3,528,697 A 9/1970 Wood
3,587,847 A 6/1971 Graser
3,601,439 A 8/1971 Poupitch
3,627,121 A 12/1971 Deasy
3,653,503 A 4/1972 Arneson
3,693,787 A 9/1972 Duerr
3,726,558 A 4/1973 Klygis
3,734,278 A 5/1973 Kerrigan
3,897,873 A 8/1975 Graser
3,924,739 A 12/1975 Gravesteijn
3,942,631 A 3/1976 Sutherland et al.
4,029,204 A 6/1977 Manizza
4,155,502 A 5/1979 Forte
4,304,329 A 12/1981 Graser
4,339,032 A 7/1982 Wood
4,372,599 A 2/1983 Kiedaisch et al.
4,378,879 A 4/1983 Killy
4,382,505 A 5/1983 Sutherland et al.
4,441,611 A 4/1984 Sommariva
4,471,870 A 9/1984 Uhlig
4,523,676 A 6/1985 Barrash
4,784,266 A 11/1988 Chaussadas
4,911,288 A 3/1990 Dantoin, Jr.
4,974,726 A 12/1990 Klygis et al.
5,002,225 A 3/1991 Bienaime
5,125,506 A 6/1992 Galbierz et al.
5,139,147 A 8/1992 Sutherland
5,188,225 A 2/1993 Jorba
5,193,673 A 3/1993 Rathbone et al.
5,201,412 A * 4/1993 Schuster ..... B65D 71/44 206/153
5,230,425 A 7/1993 Edqvist et al.
5,246,113 A 9/1993 Schuster
5,263,299 A 11/1993 Galbierz et al.
5,267,644 A 12/1993 Tsao
5,282,348 A 2/1994 Dampier et al.
5,297,673 A 3/1994 Sutherland
5,310,050 A 5/1994 Sutherland
5,310,051 A 5/1994 Sutherland
5,318,178 A 6/1994 Davies et al.
5,323,895 A 6/1994 Sutherland et al.
5,328,024 A 7/1994 Sutherland
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,443,153 A * 8/1995 Sutherland ..... B65D 71/44 206/152
5,445,262 A 8/1995 Sutherland
5,452,799 A * 9/1995 Sutherland ..... B65D 71/44 206/153
5,484,053 A 1/1996 Harris
5,485,914 A 1/1996 Martin
5,487,464 A 1/1996 Galbierz et al.
5,503,267 A 4/1996 Sutherland
5,520,283 A 5/1996 Sutherland
5,524,756 A 6/1996 Sutherland
5,551,566 A 9/1996 Sutherland
5,553,704 A 9/1996 Gordon et al.
5,553,705 A 9/1996 Bakx
5,590,776 A 1/1997 Galbierz
5,593,027 A 1/1997 Sutherland
5,609,247 A 3/1997 Appleton
5,682,982 A 11/1997 Stonehouse
5,706,936 A 1/1998 Bernstein
5,711,419 A 1/1998 Beales et al.
5,746,310 A 5/1998 Slomski
5,762,193 A 6/1998 Marco
5,791,463 A 8/1998 Negelen
5,816,391 A 10/1998 Harris
5,845,776 A 12/1998 Galbierz et al.
5,878,876 A 3/1999 Galbierz et al.
5,960,945 A 10/1999 Sutherland
6,039,181 A 3/2000 Whiteside
6,059,099 A 5/2000 Galbierz
6,082,532 A 7/2000 Miess
6,145,656 A 11/2000 Marco
6,315,111 B1 11/2001 Sutherland
6,394,272 B1 5/2002 Domansky
6,896,130 B2 5/2005 Theelen
7,011,209 B2 3/2006 Sutherland et al.
7,690,507 B2 4/2010 Sutherland
7,721,878 B2 5/2010 Requena
7,762,397 B2 7/2010 Coltri-Johnson et al.
7,789,231 B2 9/2010 Requena
7,823,721 B2 11/2010 Sutherland et al.
8,096,413 B2 1/2012 DePaula
8,162,135 B2 4/2012 Oliveira
8,353,398 B2 1/2013 DePaula et al.
8,387,784 B2 3/2013 Gonzalez et al.
8,443,968 B2 5/2013 DePaula
8,464,866 B2 6/2013 Sutherland et al.
8,469,184 B2 6/2013 Spivey, Sr.
8,602,209 B2 12/2013 Jones et al.
8,631,932 B2 1/2014 Holley, Jr.
8,701,878 B2 4/2014 Spivey, Sr.
8,925,720 B2 1/2015 Sutherland et al.
8,936,149 B2 1/2015 Smalley
8,955,674 B2 2/2015 Spivey, Sr. et al.
9,079,699 B2 7/2015 Holley, Jr.
9,169,050 B2 10/2015 Spivey, Sr.
9,359,093 B2 6/2016 DePaula et al.
9,446,891 B2 9/2016 Jones et al.
9,511,916 B2 12/2016 Holley, Jr.
9,669,976 B2 6/2017 Kastanek et al.
9,676,535 B2 6/2017 Spivey, Sr.
2002/0195371 A1 12/2002 Brown
2003/0080004 A1 5/2003 Olsen et al.
2003/0213705 A1 11/2003 Woog
2004/0211695 A1* 10/2004 Karlsson ..... B65D 71/44 206/427
2005/0127151 A1 6/2005 Johnson
2009/0101526 A1 4/2009 Sutherland et al.
2009/0127147 A1 5/2009 Sutherland
2010/0078337 A1 4/2010 Sutherland et al.
2010/0264043 A1 10/2010 DePaula
2015/0191287 A1 7/2015 L'Heureux et al.
2016/0325899 A1 11/2016 L'Heureux et al.
2018/0362234 A1 12/2018 L'Heureux et al.
2019/0119019 A1 4/2019 Patton
2020/0189821 A1 6/2020 Smalley

FOREIGN PATENT DOCUMENTS

EP 0 051 413 A1 5/1982
EP 0 060 504 A2 9/1982
EP 0 057 437 B1 5/1985
EP 0 496 807 6/1993
EP 0 636 096 2/1995
EP 0 398 835 B1 10/1996
EP 2 067 713 A1 6/2009
EP 1 528 007 B1 10/2010
EP 3 666 684 A1 6/2020
FR 2 737 196 A1 1/1997
GB 1 256 684 12/1971
GB 2 321 229 A 7/1998
JP 10-297668 A 11/1998
JP 2001-519300 A 10/2001
JP 2003-146359 5/2003
JP 2015-048088 A 3/2015

(56) References Cited

FOREIGN PATENT DOCUMENTS

| | | | |
|---|---|---|---|
| KR | 10-2005-0051616 | A | 6/2005 |
| WO | WO 93/02941 | | 2/1993 |
| WO | WO 93/21083 | | 10/1993 |
| WO | WO 93/25439 | A1 | 12/1993 |
| WO | WO 94/22738 | A1 | 10/1994 |
| WO | WO 96/26128 | A1 | 8/1996 |
| WO | WO 2008/058294 | A1 | 5/2008 |
| WO | WO 2010/006629 | A1 | 1/2010 |

OTHER PUBLICATIONS

European Search Report for EP 19 18 0439 dated Jan. 10, 2020.
International Search Report and Written Opinion for PCT/US2019/034491 dated Sep. 19, 2019.
International Search Report and Written Opinion for PCT/US2019/034490 dated Sep. 19, 2019.
International Search Report and Written Opinion for PCT/US2019/034494 dated Sep. 19, 2019.
International Search Report and Written Opinion for PCT/US2019/034489 dated Sep. 19, 2019.
International Search Report and Written Opinion for PCT/US2019/034493 dated Sep. 20, 2019.
European Search Report for EP 19 18 0436 dated Jan. 22, 2020.
European Search Report for EP 19 18 0446 dated Feb. 3, 2020.
European Search Report for EP 19 18 0453 dated Feb. 10, 2020.
International Search Report and Written Opinion for PCT/US2020/024614 dated Sep. 15, 2020.
European Search Report for EP 20 16 8268 dated Oct. 2, 2020.
International Search Report and Written Opinion for PCT/US2020/054205 dated Jan. 20, 2021.
U.S. Appl. No. 17/118,999, filed Dec. 11, 2020.
U.S. Appl. No. 17/119,016, filed Dec. 11, 2020.
U.S. Appl. No. 17/119,040, filed Dec. 11, 2020.
U.S. Appl. No. 16/562,957, filed Sep. 6, 2019.
U.S. Appl. No. 17/036,775, filed Sep. 29, 2020.
International Search Report and Written Opinion for PCT/US2020/064472 dated Mar. 15, 2021.
International Search Report and Written Opinion for PCT/US2020/064471 dated Mar. 29, 2021.
International Search Report and Written Opinion for PCT/US2020/064473 dated Apr. 1, 2021.
European Search Report for EP 20 20 533 dated Mar. 23, 2021.

* cited by examiner

CARRIER FOR CONTAINERS

CROSS-REFERENCE TO RELATED APPLICATIONS

This application claims the benefit of each of U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, and U.S. Provisional Patent Application No. 62/841,449, filed on May 1, 2019.

INCORPORATION BY REFERENCE

The disclosures of each of U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, and U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, and U.S. Provisional Patent Application No. 62/481,449, filed on May 1, 2019, are hereby incorporated by reference for all purposes as if presented herein in their entirety.

BACKGROUND OF THE DISCLOSURE

The present disclosure generally relates to cartons or carriers for holding, displaying, and/or transporting containers.

SUMMARY OF THE DISCLOSURE

According to one aspect of the disclosure, a carrier for holding a plurality of containers comprises a plurality of panels comprising at least one central panel and at least one attachment panel configured to receive a portion of one or more containers of the plurality of containers. The at least one central panel is for being positioned between and attached to adjacent containers of the plurality of containers.

According to another aspect of the disclosure, a blank for forming a carrier for holding a plurality of containers comprises a plurality of panels comprising at least one central panel and at least one attachment panel configured to receive a portion of one or more containers of the plurality of containers. The at least one central panel is for being positioned between and attached to adjacent containers of the plurality of containers in the carrier formed from the blank.

According to another aspect of the disclosure, a method of forming a carrier for holding a plurality of containers comprises obtaining a blank comprising a plurality of panels, the plurality of panels comprising at least one central panel and at least one attachment panel configured to receive a portion of one or more containers of the plurality of containers. The method further comprises folding the plurality of panels such that the at least one central panel is positioned between adjacent containers of the plurality of containers. The method further comprises attaching the at least one central panel to at least one container of the plurality of containers.

According to another aspect of the disclosure, a package comprises a plurality of containers and a carrier comprising a plurality of panels comprising at least one central panel and at least one attachment panel, a portion of one or more containers of the plurality of containers is received in the attachment panel. The at least one central panel is positioned between and attached to adjacent containers of the plurality of containers.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

Detailed Description of the Exemplary Embodiments

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., aluminum cans) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
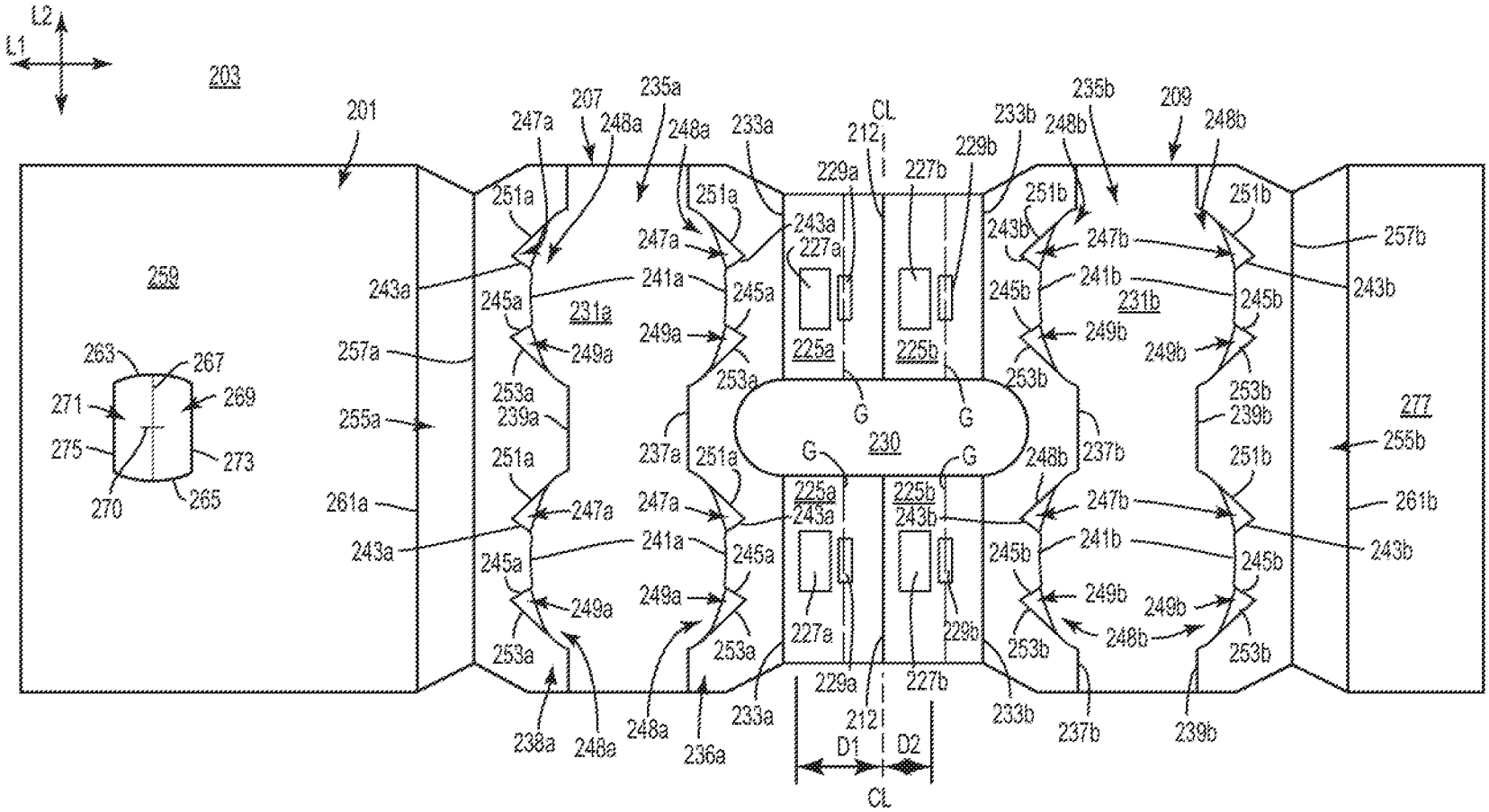
FIG. 1 is a plan view of an outer surface of a blank for forming a carrier according to a first exemplary embodiment of the disclosure.
Figure 5:
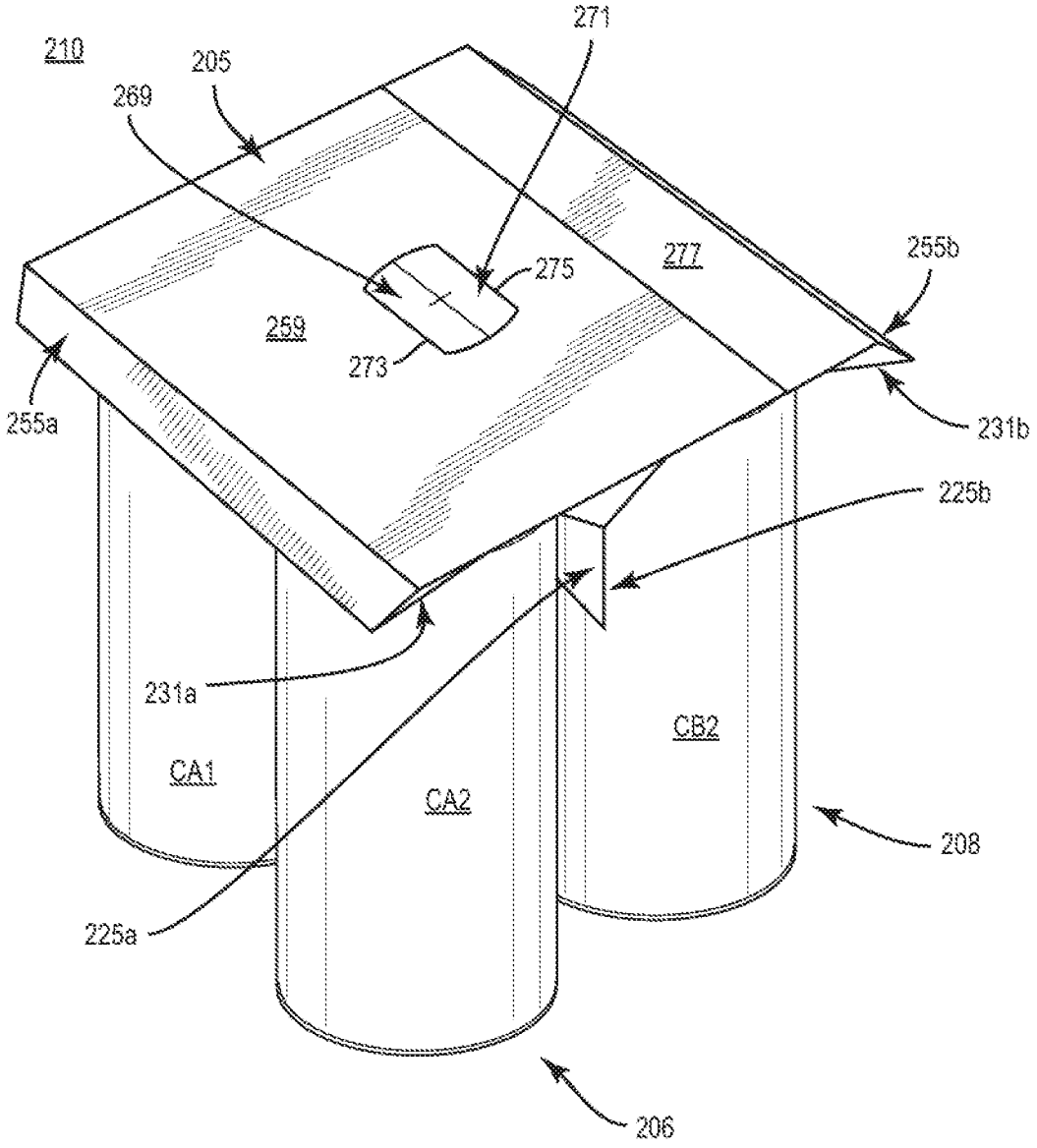
FIG. 5 is a perspective view of a package and carrier formed from the blank of FIG. 1 according to the first exemplary embodiment.

FIG. 1 shows a plan view of an exterior side 201 of a blank 203 used to form a carrier 205 (FIG. 5) in accordance with a first exemplary embodiment of the disclosure. As shown in FIG. 5, the carrier 205 is sized to contain or support four containers, with two containers CA1, CA2 being attached to a front portion 206 of the carrier 205 and two containers CB1, CB2 being attached to a back portion 208 of the carrier 205. In the illustrated embodiment, the containers CA1, CA2, CB1, CB2, can be beverage cans, or could be any other suitable type and size of container without departing from the disclosure. The carrier 205 can be sized and shaped to hold more or less than four containers. In one embodiment, the front portion 206 and the back portion 208 of the carrier 205 each have two containers, and in other embodiments, the front portion 206 and the back portion 208 of the carrier 205 can carry more or less than two containers without departing from the disclosure. The carrier 205 can be provided together with one or more container as a package 210 (FIG. 5).

As shown in FIG. 1, the blank 203 has a longitudinal axis L1 and a lateral axis L2. The blank 203 has a front portion 207 for forming the front portion 206 of the carrier 205, and a back portion 209 for forming the back portion 208 of the carrier 205. The front portion 207 and the back portion 209 of the blank 203 are foldably connected at a lateral fold line 212 that forms a lateral centerline CL of the blank 203, as shown. As discussed in further detail below, the blank 203 is partially formed into the carrier 205 by folding the blank 203 at the fold line 212 along the centerline CL so that the front portion 207 and the back portion 209 of the blank 203 are overlapped in at least partial face-to-face contact.

In the illustrated embodiment, the front portion 207 of the blank 203 comprises a front central panel 225*a* having a pair of adhesive or glue openings 227*a* at interior portions thereof and a pair of surface features 229*a* adjacent the respective glue openings 227*a*. The surface features 229*a* can be, for example, an embossed feature or other at least partially raised or recessed surface configuration. As described further herein, the front central panel 225*a* is bisected or otherwise partitioned by a handle opening 230 that extends from a portion of the front portion 207 of the blank 203 and across the centerline CL to a portion of the back portion 209 of the blank 203. As also described further herein, for example, the top edges of the respective glue openings 227*a* are spaced a longitudinal distance D1 away from the centerline CL that is greater than a longitudinal distance D2 that the top edges of respective glue openings 227*b* of the back portion 209 of the blank 203 are spaced away from the centerline CL.

A front container retention panel or front attachment panel 231*a* is foldably connected to the front central panel 225*a* at a lateral fold line 233*a* that is interrupted by an end portion of the handle opening 230. The front attachment panel 231*a* includes a container retention portion 235*a* that is at least partially defined between a pair of longitudinally-spaced lateral fold lines 237*a*, 239*a* that are each interrupted by a respective pair of longitudinally-spaced cuts 241*a* that can each include one or more curved and/or angled portions. As shown, the longitudinally-spaced cuts 241*a* define container retention tabs 248*a* that extend outwardly from the container retention portion 235*a*. As also shown, respective oblique cuts 243*a*, 245*a* extend outwardly from each respective cut 241*a* to define a respective pair of container retention flaps 247*a*, 249*a* that are foldably connected to the front attachment panel 231*a* at respective oblique fold lines 251*a*, 253*a*.

As shown, an interior marginal portion 236*a* of the attachment panel 231*a* is defined between the fold lines 237*a*, 233*a*, and an exterior marginal portion 238*a* of the attachment panel 231*a* is defined between the fold line 239*a* and a lateral fold line 257*a* adjacent the attachment panel 231*a*. A bevel or front side panel 255*a*, as shown, is foldably connected to the front attachment panel 231*a* at the lateral fold line 257*a*, and a top panel 259 is foldably connected to the front side panel 255*a* at a lateral fold line 261*a*. The top panel 259, as shown, includes handle features that include a pair of opposed curved cuts 263, 265 and a lateral cut 267 extending from the curved cut 263 to the curved cut 265 to define a pair of handle flaps 269, 271 that are foldably connected to the top panel 259 at respective lateral fold lines 273, 275. As described herein, the handle flaps 269, 271 can be folded away from the top panel 259 to form an opening in the top panel 259. A relief cut 270 can extend from a portion of the handle flap 269, across the cut 267, and onto a portion of the handle flap 271. Handle features of the carrier 205 include the handle features in the top panel 259, and can also include the handle opening 230. The carrier 205 can have a different arrangement of handle features, or can be devoid of handle features, without departing from the disclosure.

In the illustrated embodiment, the back portion 209 of the blank 203 includes a back central panel 225*b*, a back container retention panel or back attachment panel 231*b*, and a back side panel 255*b* having associated features that are generally a mirror-image of the corresponding panels and flaps of the front portion 207 of the blank 203. Corresponding components (e.g., panels, flaps, fold lines, cuts, etc.) have been designated by corresponding reference numbers that differ by the "a" or "b" suffix, with the "a" components corresponding to the front portion 207 of the blank 203 and the "b" components corresponding to the back portion 209 of the blank 203. The back portion 209 of the blank 203 also includes an attachment flap 277 foldably connected to the back side panel 255*b* at a lateral fold line 261*b*.

As also shown, glue G can be applied to one or more portions of the central panels 225*a*, 225*b*, e.g., across the respective surface features 229*a*, 229*b*. While the glue G is illustrated on the exterior surface 201 of the blank 203 in FIG. 11 for clarity of illustration and to indicate positioning relative to other features of the blank 203, it will be understood that the glue G is applied to at least the interior surface of the central panels 225*a*, 225*b*. In one embodiment, glue G can be applied to both the interior surface and the exterior surface of the central panels 225*a*, 225*b*.

Any of the panels, flaps, fold lines, cuts, or other features could be otherwise shaped, arranged, and/or omitted from the blank 203 without departing from the disclosure. The blank 203 could be sized and/or shaped to accommodate more or less than four containers without departing from this disclosure.

Figure 2:
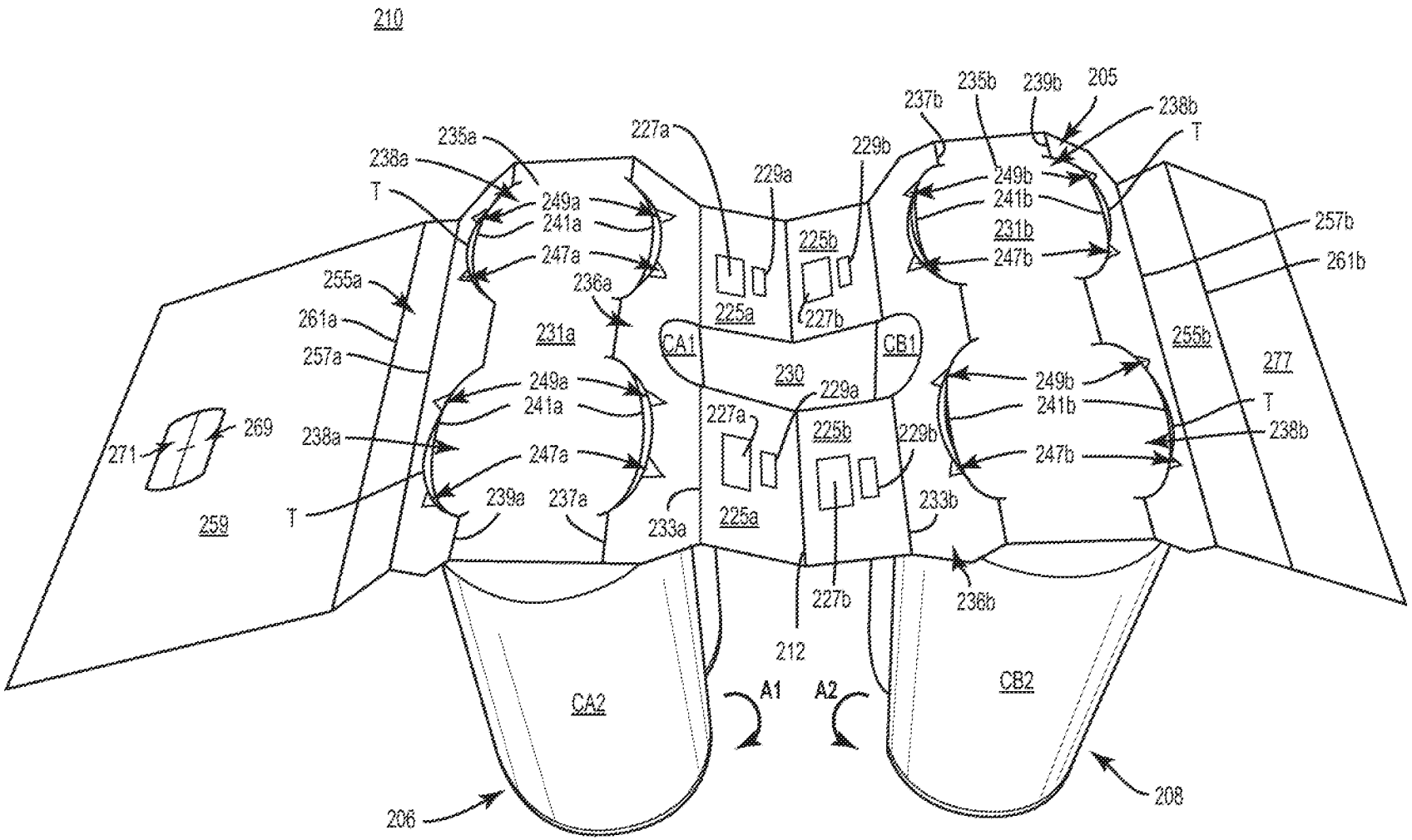
FIG. 2 is a perspective view of a partially folded configuration of a carrier formed from the blank of FIG. 1 according to the first exemplary embodiment.

As shown in FIG. 2 (in which the glue G is omitted for clarity of illustration), the exterior surface 201 of the blank 203 can be placed atop the containers CA1, CA2, CB1, CB2 such that the container retention portion 235*a* of the front attachment panel 231*a* overlies the containers CA1, CA2 and such that the container retention portion 235*b* of the back attachment panel 231*b* overlies the containers CB1, CB2. Further downward positioning of the attachment panels 231*a*, 231*b* over the plurality of containers CA1, CA2, CB1, CB2 can activate the respective container retention portions 235*a*, 235*b* to engage respective containers. For example, as the front attachment panel 231*a* is lowered or urged downwardly onto the containers CA1, CA2, the container retention portion 235*a* can at least partially separate from the remainder of the front attachment panel 231*a* at the cuts 241*a*, which, in turn, can cause additional separation of the respective container retention flaps 247*a*, 249*a* from the remainder of the front attachment panel 231*a* at the respective cuts 243*a*, 245*a* and such that the respective container retention flaps 247*a*, 249*a* fold at least partially outwardly from the front attachment panel 231*a* at the respective fold lines 251*a*, 253*a*. In such an arrangement, upper or top portions T of the respective containers CA1, CA2 can extend at least partially through respective openings formed by the respective cuts 241*a*. Such reconfiguration of the corresponding portions of the back attachment panel 231*b* can occur as the back attachment panel 231*b* is lowed or urged downwardly onto the containers CB1, CB2. The marginal portions 236*a*, 238*a* of the attachment panel 231*a* can fold at least partially downwardly at the respective fold lines 237*a*, 239*a* in such a configuration, and, similarly, the marginal portions 236*b*, 238*b* of the attachment panel 231*b* can fold at least partially downwardly at the respective fold lines 237*b*, 239*b*.

In this regard, the respective container retention flaps 247*a*, 249*a* and/or the respective container retention tabs 248*a* can engage a portion of the respective containers CA1, CA2, for example, an edge presented by a rim or top portion T of the respective containers CA1, CA2. It will be understood that other portions of the front attachment panel 231*a* can form a portion of the container retention portion 235*a*, for example, a portion of the front attachment panel 231*a*, disposed between the respective container retention flaps 247*a*, 249*a*, which can engage an edge presented by a rim or top portion T of the respective containers CA1, CA2 as described above. The back attachment panel 231*b* and corresponding container retention portion 235*b* can engage the containers CB1, CB2 in a similar manner as described above with respect to the engagement of the front attachment panel 231*a* and container retention portion 235*a* with respect to the containers CA1, CA2.

Figure 3:
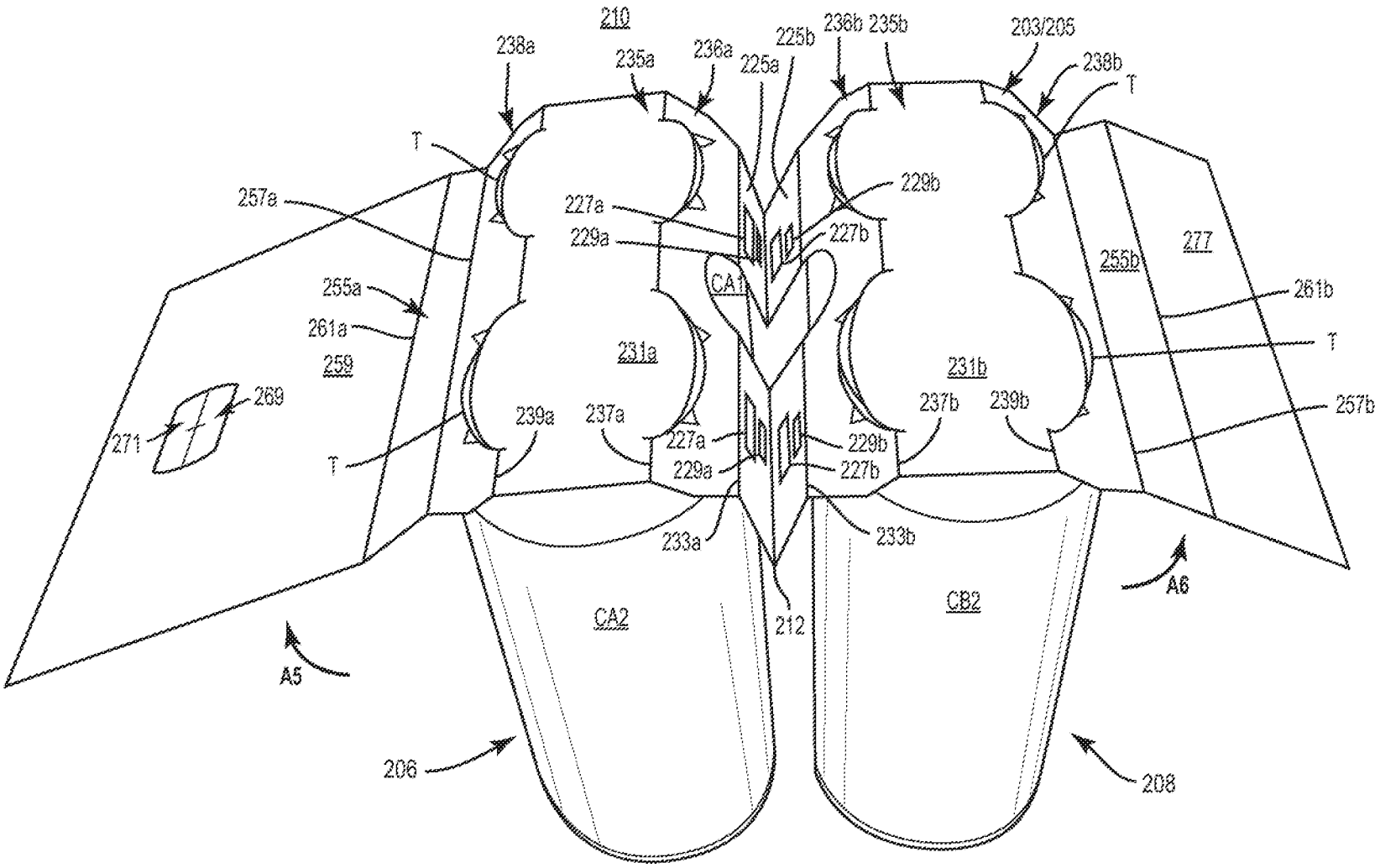
FIG. 3 is a perspective view of another partially folded configuration of a carrier formed from the blank of FIG. 1 according to the first exemplary embodiment.

As shown in FIG. 2, the front central panel 225*a* and the back central panel 225*b* can be folded at the fold line 212 in the direction of the arrows A1, A2 such that the front central panel 225*a* and the back central panel 225*b* are brought into at least partial face-to-face contact in the direction of the respective arrows A3, A4 (FIG. 3) and such that the respective glue openings 227*a*, 227*b* and the respective surface features 229*a*, 229*b* in the respective central panels 225*a*, 225*b* are positioned so as to be laterally aligned but longitudinally offset due to the different relative spacing of the respective glue openings 227*a*, 227*b* away from the centerline CL. In this regard, the central panels 225*a*, 225*b* are arranged such that a portion of the front central panel 225*a* overlaps each of the glue openings 227*b* and a portion of the back central panel 225*b* overlaps each of the glue openings 227*a* to provide communication between the central panels 225*a*, 225*b* and respective surfaces upon which the respective containers CA1, CA2, CB1, CB2 can be adhered or otherwise attached, as described further herein. Such rearrangement of the central panels 225*a*, 225*b* can also cause the respective central panels 225*a*, 225*b* to be folded downwardly relative to the respective attachment panels 231*a*, 231*b* at the respective fold lines 233*a*, 233*b*.

Figure 4:
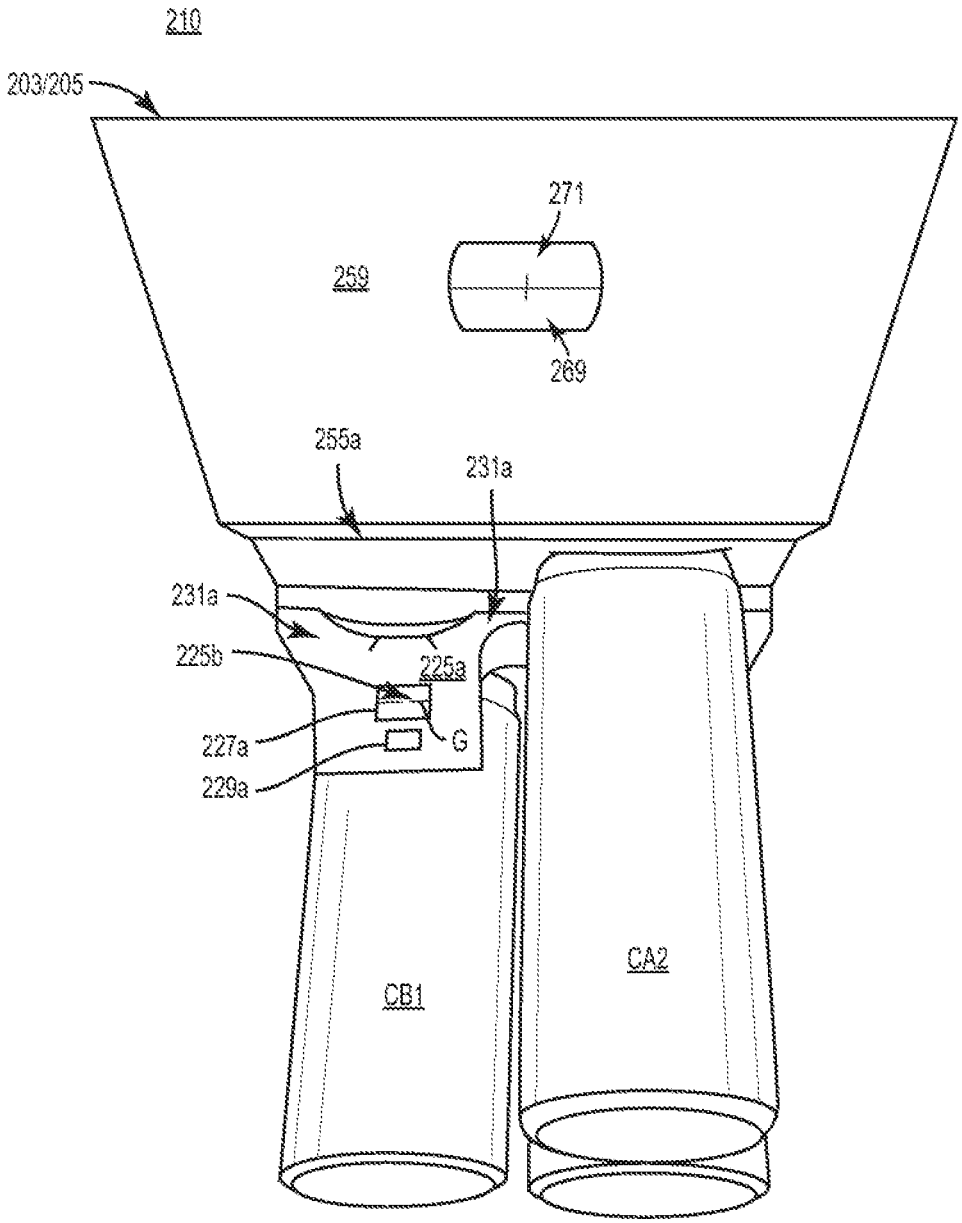
FIG. 4 is a perspective view of another partially folded configuration of a carrier formed from the blank of FIG. 1 according to the first exemplary embodiment and having a container removed.

Referring to FIG. 4, in which the container CA1 is removed for clarity of illustration, glue G can be at least partially aligned with the glue openings 227*a* to adhere the containers CA1, CA2 to respective exposed portions of the central panel 225*b* through the respective glue openings 227*a*, and the glue G can be at least partially aligned with the respective glue openings 227*b* to adhere the containers CB1 and CB2 to respective exposed portions of the central panel 225*a* through the respective glue openings 227*b*. The glue G can cover at least a portion of the surface features 229*a*, 229*b* such that one or more of the surface features 229*a*, 229*b* presents additional surfaces for adhesion and/or spacing between the front portion 206 and the back portion 208 of the carrier 205.

The attachment of the containers CA1, CA2, CB1, CB2 to the respective central panels 225*a*, 225*b* can provide retention and support of the respective containers, e.g., such that the containers do not detach from the carrier 205 under their own weight, in addition to or alternative to the container retention and support provided by the respective container retention portions 235*a*, 235*b*. For example, in one embodiment, one or more of the containers CA1, CA2, CB1, CB2 can be attached to a respective central panel 225*a*, 225*b* with glue G, without additional retention and support provided by a container retention portion as described above.

The glue G described herein can be, for example, a hot melt adhesive, a high tack glue, an epoxy, a polymeric cement, etc., or combinations thereof.

Such enhanced attachment of the respective containers to the respective central panels 225*a*, 225*b* with the glue G can also provide enhanced integrity to the carrier 205, e.g., by providing opposing adhesive forces on the respective central panels 225*a*, 225*b* such that the central panels 225*a*, 225*b* are compressed therebetween. For example, in one embodiment, as the carrier 205 is lifted, the containers CA1, CA2 can at least partially pull the portions of the back central panel 225*b* to which they are attached through the respective glue openings 227*a* toward the front central panel 225*a* under the at least partial weight of the containers CA1, CA2. Respective portions of the front central panel 225*a* can be pulled toward the back central panel 225*b* through the respective glue openings 227*b* by the containers CB1, CB2 in a similar manner.

Still referring to FIGS. 1-5, the front side panel 255*a* can be folded upwardly at the fold line 257*a* in the direction of the arrow A5, for example, to be at an oblique arrangement relative to the containers CA1, CA2, CB1, CB2 and the top panel 259 can be folded at the fold line 261*a* in the direction of the arrow A5 into at least partial face-to-face contact with at least a portion of the attachment panels 231*a*, 231*b*. Similarly, the back side panel 255*b* can be folded upwardly at the fold line 257*b* in the direction of the arrow A6 into an oblique arrangement with the containers CA1, CA2, CB1, CB2, and the attachment flap 277 can be folded at the fold line 261*b* in the direction of the arrow A6 into at least partial face-to-face contact with the top panel 259 and/or the attachment panel 231*b*, as shown in FIG. 5. Such an arrangement can be maintained with an adhesive such as glue.

Accordingly, containers can be engaged by the respective attachment panels 231*a*, 231*b* and can extend below the respective container retention portions 235*a*, 235*b* in the assembled carrier 205/package 210. In such an arrangement, the containers CA1, CA2 extend below the container retention portion 235*a* in the front portion 206 of the carrier 205, and the containers CB1, CB2 extend below the container retention portion 235*b* in the back portion 208 of the carrier 205, with the top panel 259 and the attachment flap 277 overlying respective portions of the respective container retention portions 235*a*, 235*b*. Further, the front central panel 225*a* and the back central panel 225*b* are positioned between and attached to respective ones of the containers CA1, CA2, CB1, CB2.

Still referring to FIGS. 1-5, the carrier 205 can be grasped by separating one or both of the handle flaps 269, 271 at the respective cuts 263, 265, 267 and folding the respective handle flaps 269, 271 downwardly at the respective fold lines 273, 275 toward the handle opening 230 such that a user can insert one or more fingers therethrough to grasp a portion of the package 210/carrier 205, for example, an underside of the top panel 259 and/or the attachment panels 231*a*, 231*b*. The alignment of the handle opening 230 below the handle features in the top panel 259, e.g., handle flaps 269, 271 in the erected package 210/carrier 205 provides a space through which the consumer's fingers can extend below the top panel 259 into an interior portion of the carrier 205.

The package 210/carrier 205 described above has a compact structure that can, for example, provide materials savings and waste reduction. Additionally, the arrangement of the glue G among the containers CA1, CA2, CB1, CB2 as well as the central panels 225*a*, 225*b* provides multiple points of attachment that results in a robust structure for holding and carrying the containers CA1, CA2, CB1, CB2. Further, the exposure of one or more portions of the containers CA1, CA2, CB1, CB2 on exterior portions of the carrier 205/package 210 provides a consumer with a clear view of labeling or surface graphics associated with the containers CA1, CA2, CB1, CB2, as well as providing convenient access to remove one or more of the containers CA1, CA2, CB1, CB2 from the carrier 205/package 210, for example, by peeling a respective container away from an adjacent container and/or portion of the carrier 205/package 210. Peeling or pulling the containers CA1, CA2, CB1, CB2 away from a respective central panel 225*a*, 225*b* can involve pulling the respective container with a force sufficient to overcome the adhesive bond of the respective container and the respective central panel 225*a*, 225*b* provided by the glue G. In one embodiment, the glue G can be selected so as to remain on a respective central panel 225*a*, 225*b*, e.g., such that substantially little or no glue G remains on the container as it is removed. One or more of the containers CA1, CA2, CB1, CB2, in one embodiment, can be reattached to a respective central panel 225*a*, 225*b* following therefrom by pressing the container against a respective region of glue G.

Figure 6:
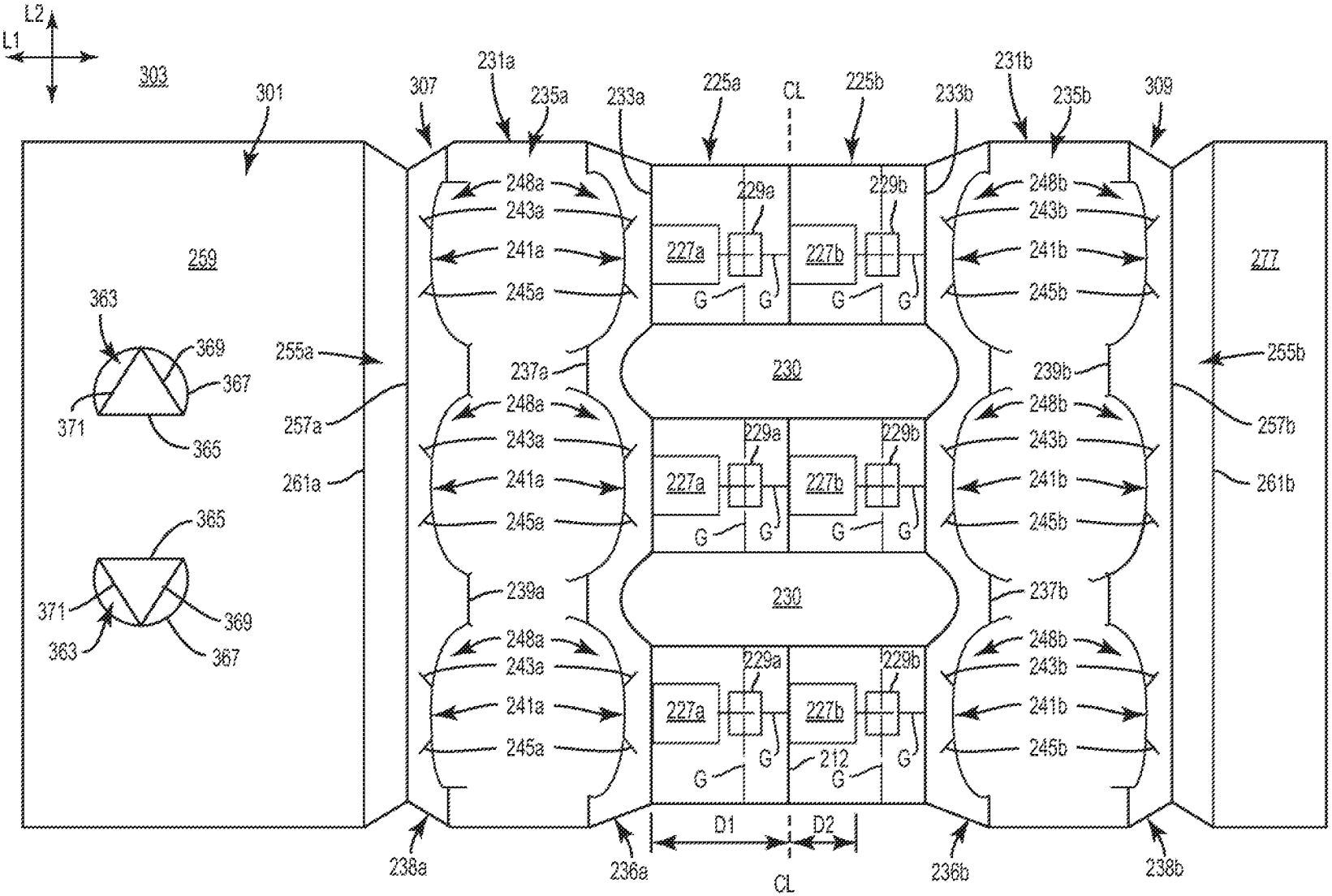
FIG. 6 is a plan view of an outer surface of a blank for forming a carrier according to a second exemplary embodiment of the disclosure.
Figure 10:
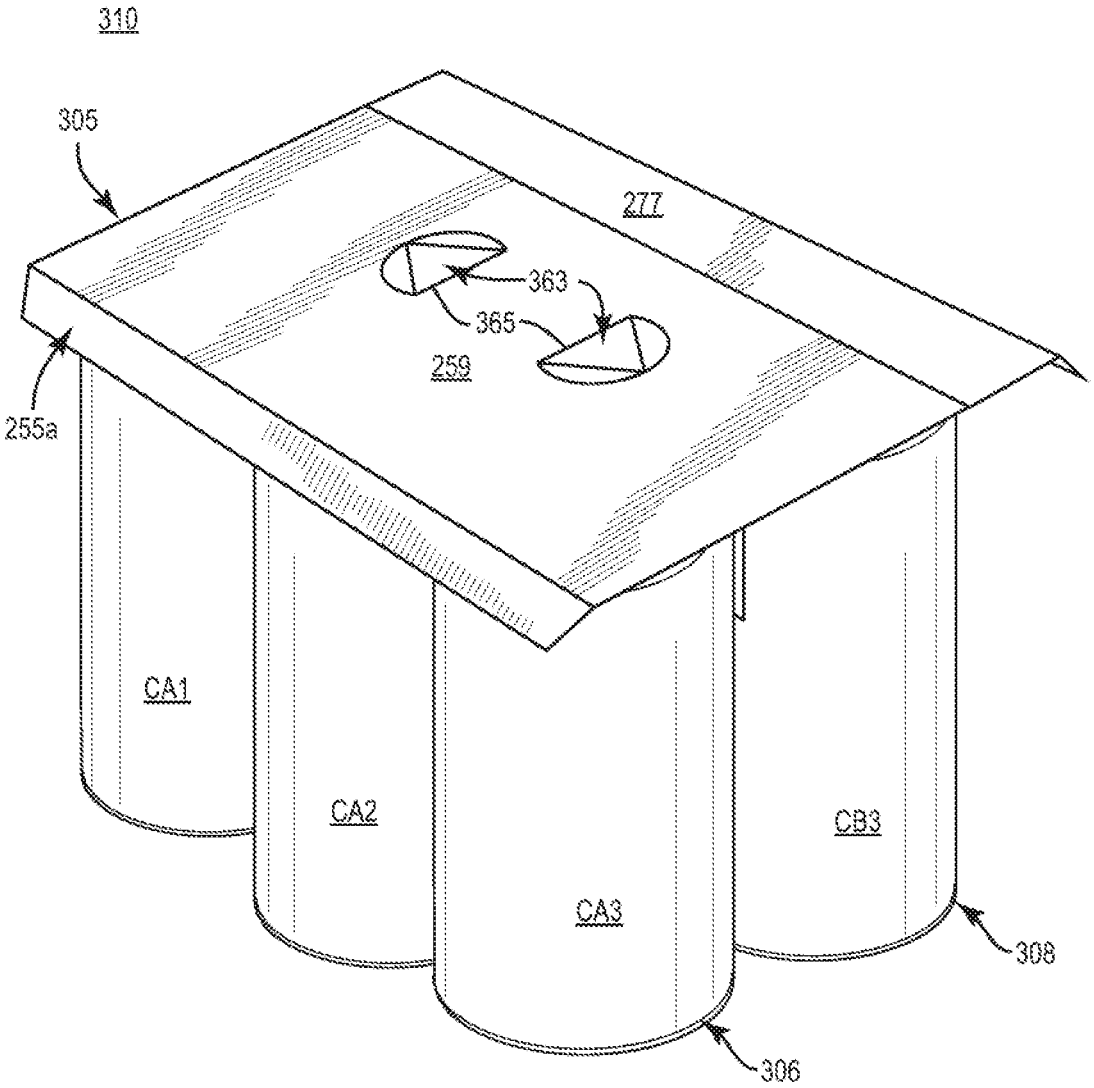
FIG. 10 is a perspective view of a package and carrier formed from the blank of FIG. 6 according to the second exemplary embodiment.

FIG. 6 is a plan view of the exterior side 301 of a blank, generally indicated at 303, used to form a carrier 305 (FIG. 10) for containing one or more containers according to a second exemplary embodiment of the disclosure. The blank 303 and the carrier 305 formed therefrom can have one or more features that are substantially similar to the blank 203 (FIG. 1) and the carrier 205 (FIG. 5) of the first exemplary embodiment of the disclosure, and like or similar components are referenced with like or similar reference numbers.

As shown, the blank 303 includes a front portion 307 and a back portion 309 and includes additional container retention features such that the respective container retention portions 235*a*, 235*b* are configured to engage and support three containers CA1, CA2, CA3 in the front portion 306 of the carrier 305 formed from the blank 303 and three containers CB1, CB2, CB3 in the back portion 308 of the carrier 305. In this regard, the central panels 225*a*, 225*b* of the blank 303 are partitioned by a pair of handle openings 230 (broadly, respective "first handle opening" and "second handle opening"), each having marginal portions that extend into the respective attachment panels 231, 231*b*.

Furthermore, the cuts 241*a*, 241*b*, 243*a*, 243*b*, 245*a*, 245*b* can form a plurality of flexible edges in the respective container retention portions 235*a*, 235*b* for engaging top portions of respective containers, as well as defining the container retention tabs 248*a*, 248*b* that extend away from the respective container retention portions 235*a*, 235*b*.

As shown, the top panel 259 of the blank 303 includes handle features that include a pair of handle flaps 363 (broadly, respective "first handle feature" and "second handle feature") that are each foldably connected to the top panel 259 at a respective fold line 365 and which are at least partially defined by a respective curved cut 367 that extends from one endpoint to the other endpoint of each respective fold line 365. Each handle flap 363 includes respective oblique fold lines 369, 371 that extend from the endpoints of the respective fold line 365 to intersect at the respective cut 367. A consumer can separate the respective handle flaps 363 at the respective cuts 367 and fold the handle flaps 363 downwardly at the respective fold lines 265 to form openings in the top panel 259 that provide access to a respective handle opening 230 to insert one or more fingers therethrough to grasp a portion of the carrier 305 formed from the blank 303, for example, an underside of the top panel 259 and/or the attachment panels 231*a*, 231*b*. One or more portions of the respective handle flaps 363 can fold at one or more of the respective oblique fold lines 369, 371, for example, to provide additional protection for the consumer's fingers and/or to provide separation among adjacent containers. Handle features of the carrier 305 include the handle features in the top panel 259, and can also include the handle openings 230. The carrier 305 can have a different arrangement of handle features, or can be devoid of handle features, without departing from the disclosure.

As also shown, glue G can be applied to one or more portions of the central panels 225*a*, 225*b*, e.g., across the respective surface features 229*a*, 229*b*. While the glue G is illustrated on the exterior surface 301 of the blank 303 in FIG. 6 for clarity of illustration and to indicate positioning relative to other features of the blank 303, it will be understood that the glue G is applied to at least the interior surface of the central panels 225*a*, 225*b*. In one embodiment, glue G can be applied to both the interior surface and the exterior surface of the central panels 225*a*, 225*b*.

Referring additionally to FIGS. 7-10, formation of the carrier 305 from the blank 303 and an associated package 310 that includes the containers CA1, CA2, CA3, CB1, CB2, CB3 is illustrated according to one exemplary embodiment of the disclosure. It will be understood that the carrier 305 can be formed in a similar manner to that of the carrier 205 described above and as shown in FIGS. 2-5, and is provided with at least similar properties and advantages.

Figure 7:
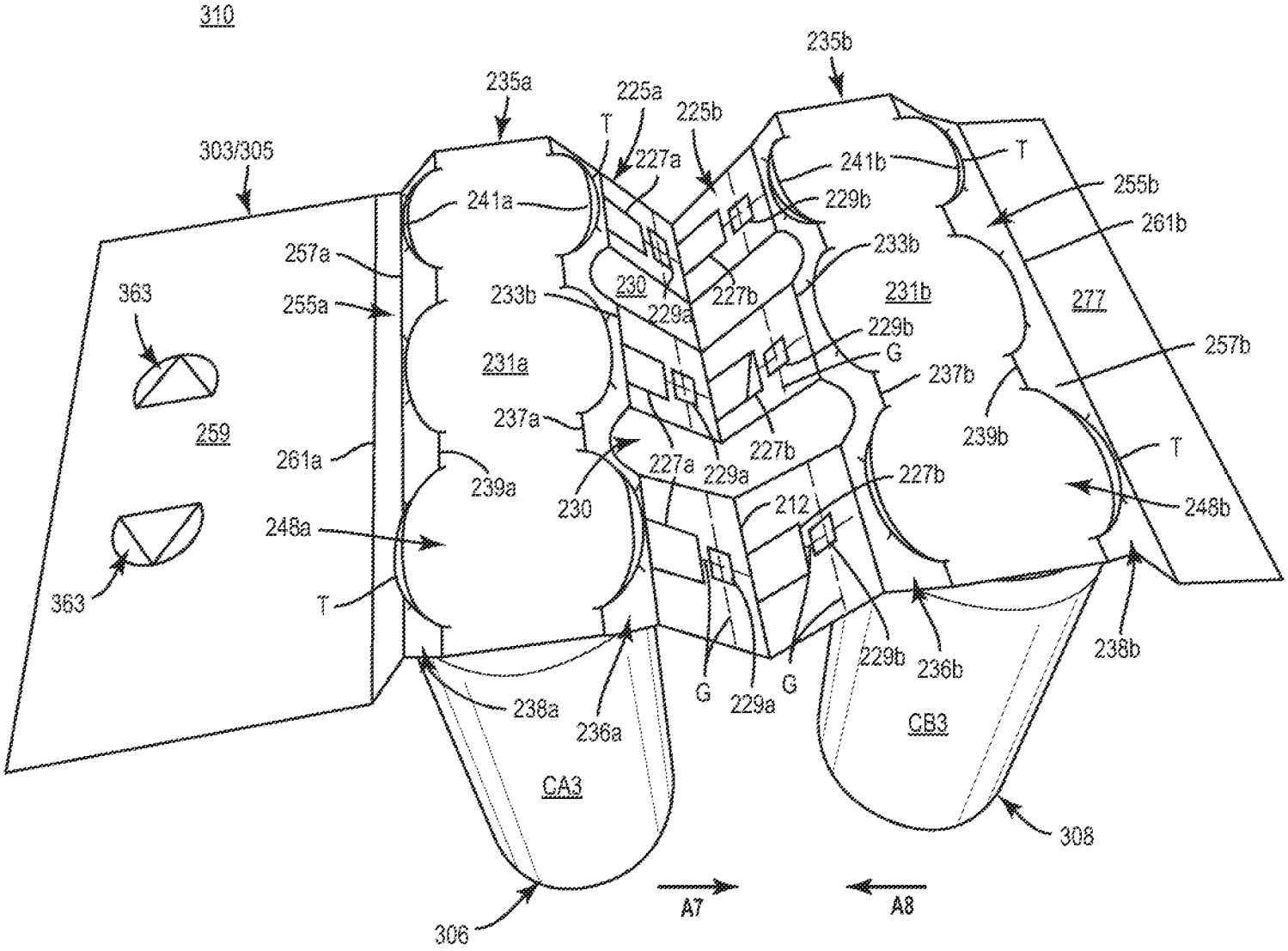
FIG. 7 is a perspective view of a partially folded configuration of a carrier formed from the blank of FIG. 6 according to the second exemplary embodiment.
Figure 8:
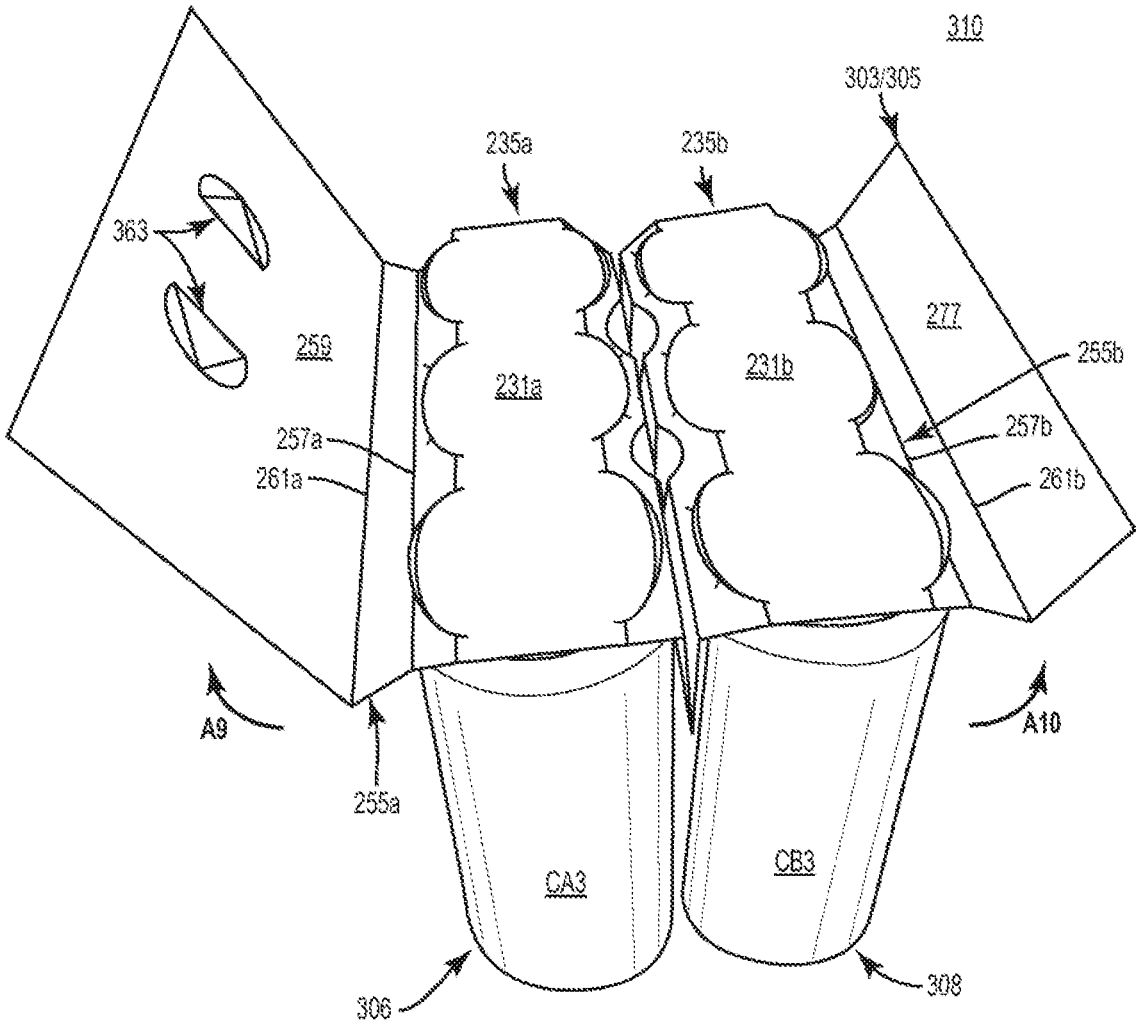
FIG. 8 is a perspective view of another partially folded configuration of a carrier formed from the blank of FIG. 6 according to the second exemplary embodiment.

As shown in FIG. 7, the exterior surface 301 of the blank 303 can be placed atop the containers CA1, CA2, CB1, CB2, CB3 such that the container retention portion 235*a* of the front attachment panel 231*a* overlies the containers CA1, CA2, CA3 and such that the container retention portion 235*b* of the back attachment panel 231*b* overlies the containers CB1, CB2, CB3. Further downward positioning of the attachment panels 231*a*, 231*b* over the plurality of containers CA1, CA2, CA3, CB1, CB2, CB3 can activate the respective container retention portions 235*a*, 235*b* to engage respective containers. For example, as the front attachment panel 231*a* is lowered or urged downwardly onto the containers CA1, CA2, CA3 the container retention portion 235*a* can at least partially separate from the remainder of the front attachment panel 231*a* at the cuts 241*a* such that an upper or top portion T of the respective containers CA1, CA2, CA3 can at least partially protrude through respective openings formed by the respective cuts 241*a*. Such reconfiguration of the corresponding portions of the back attachment panel 231*b* can occur as the back attachment panel 231*b* is lowed or urged downwardly onto the containers CB1, CB2, CB3. The marginal portions 236*a*, 238*a* of the attachment panel 231*a* can fold at least partially downwardly at the respective fold lines 237*a*, 239*a* in such a configuration, and, similarly, the marginal portions 236*b*, 238*b* of the attachment panel 231*b* can fold at least partially downwardly at the respective fold lines 237*b*, 239*b*.

In this regard, portions of the container retention portion 235*a*, e.g., the container retention tabs 248*a*, can engage one or more portions of the respective containers CA1, CA2, CA3, for example, an edge presented by a rim or top portion T of the respective containers CA1, CA2, CA3. It will be understood that other portions of the front attachment panel 231*a* can form a portion of the container retention portion 235*a*, for example, a portion of the front attachment panel 231*a* disposed between and/or adjacent the respective cuts 243*a*, 245*a*, which can engage an edge presented by the rim or top portion T of the respective containers CA1, CA2, CA3 as described above. The back attachment panel 231*b* and corresponding container retention portion 235*b* can engage the containers CB1, CB2, CB3 in a similar manner as described above with respect to the engagement of the front attachment panel 231*a* and container retention portion 235*a* with respect to the containers CA1, CA2, CA3.

The front central panel 225*a* and the back central panel 225*b* can be folded at the fold line 212 and brought into at least partial face-to-face contact in the direction of the respective arrows A7, A8, and such that the respective glue openings 227*a*, 227*b* are positioned to be in general alignment so as to be laterally aligned but longitudinally offset. In this regard, the central panels 225*a*, 225*b* are arranged such that a portion of the front central panel 225*a* overlaps each of the glue openings 227*b* and a portion of the back central panel 225*b* overlaps each of the glue openings 227*a* to provide communication between the central panels 225*a*, 225*b* and respective surfaces upon which the respective containers CA1, CA2, CA3 and CB1, CB2, CB3 can be adhered or otherwise attached, as described further herein.

Figure 9:
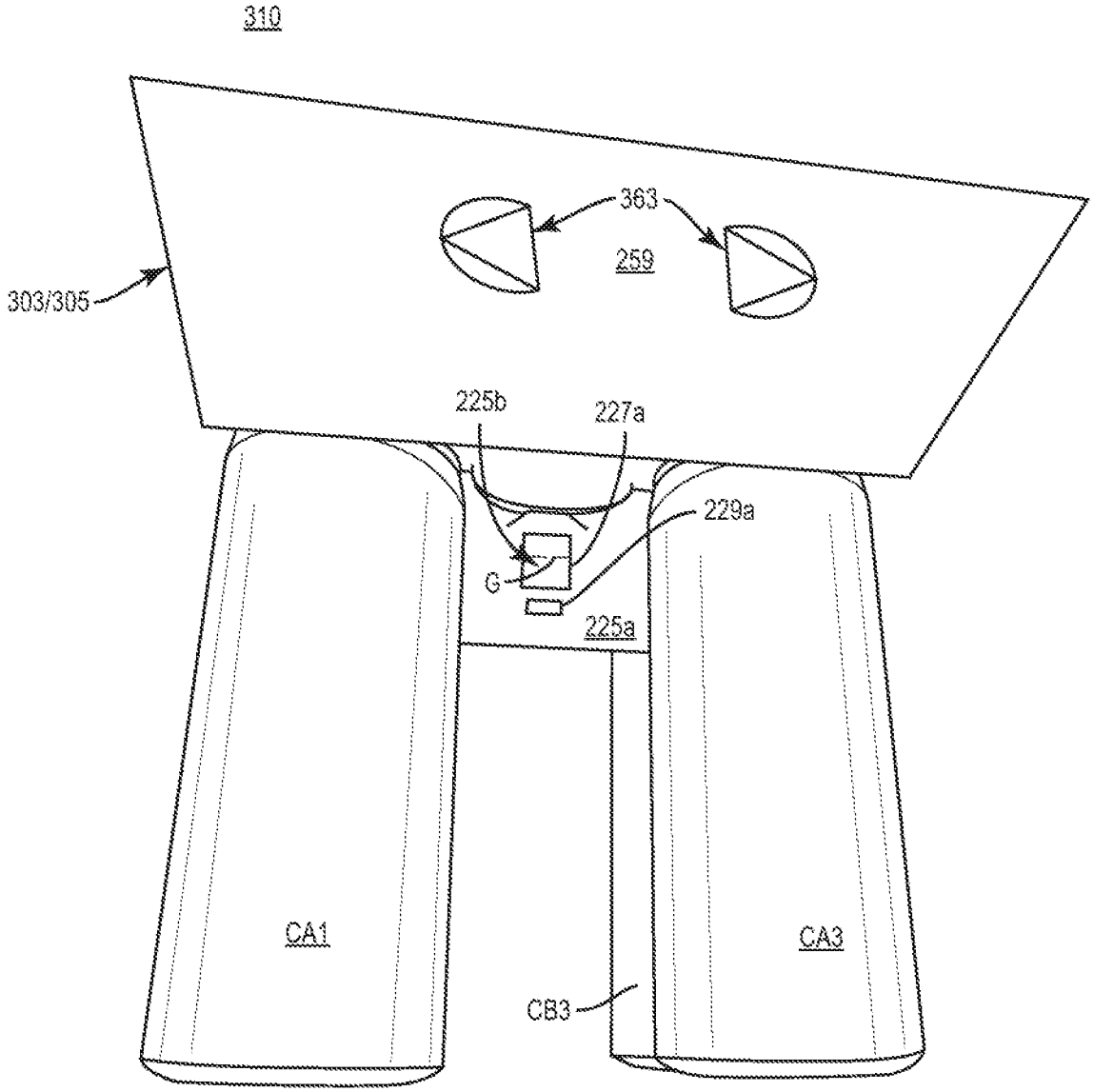
FIG. 9 is a perspective view of another partially folded configuration of a carrier formed from the blank of FIG. 6 according to the second exemplary embodiment and having a pair of containers removed.

As shown in FIG. 9, in which the container CA2 is removed for clarity of illustration, glue G can be provided in alignment with the glue openings 227*a* to adhere the containers CA1, CA2, CA3 to respective exposed portions of the central panel 225*b* through the respective glue openings 227*a*, and the glue G can be provided in alignment with the glue openings 227*b* to adhere the containers CB1, CB2, CB3 to respective exposed portions of the central panel 225*a* through the respective glue openings 227*b*. In one embodiment, the glue G can cover at least a portion of the surface features 229*a*, 229*b* such that one or more of the surface features 229*a*, 229*b* presents additional surfaces for adhesion and/or spacing between the front portion 306 and the back portion 308 of the carrier 305.

As described above, the adhesion of the containers of the front portion 306 of the carrier 305 to respective surfaces of the back central panel 225*b* exposed through the glue openings 227*a*, and the adhesion of the containers of the back portion 308 of the carrier 305 to respective surfaces of the front central panel 225*a* exposed through the glue openings 227*b* can provide compression between the central panels 225*a*, 225*b* and stability to the carrier 305. The containers can be attached to the respective central panels 225*a*, 225*b* in a different configuration as described above, e.g., a configuration in which the containers are not engaged by a container retention portion or a configuration in which a fewer number of or no glue openings are provided.

Still referring to FIGS. 7-10, the front side panel 255*a* can be folded upwardly at the fold line 257*a* in the direction of the arrow A9, for example, to be at an oblique arrangement relative to the containers CA1, CA2, CA3, CB1, CB2, CB3, and the top panel 259 can be folded at the fold line 261*a* in the direction of the arrow A9 into at least partial face-to-face contact with at least a portion of the attachment panels 231*a*, 231*b*. Similarly, the back side panel 255*b* can be folded upwardly at the fold line 257*b* in the direction of the arrow A10 into an oblique arrangement with the containers CA1, CA2, CA3, CB1, CB2, CB3, and the attachment flap 277 can be folded at the fold line 261*b* in the direction of the arrow A10 into at least partial face-to-face contact with the top panel 259 and/or the attachment panel 231*b*.

Accordingly, containers can be engaged by the respective attachment panels 231*a*, 231*b* and can extend below the respective container retention portions 235*a*, 235*b* in the assembled carrier 305/package 310. In such an arrangement, containers CA1, CA2, CA3 extend below the container retention portion 235*a* in the front portion 306 of the carrier 305, and containers CB1, CB2, CB3 extend below the container retention portion 235*b* in the back portion 308 of the carrier 305, with the top panel 259 and the attachment flap 277 overlying respective portions of the respective container retention portions 235*a*, 235*b*. Further, the front central panel 225*a* and the back central panel 225*b* are positioned between and attached to respective ones of the containers CA1, CA2, CA3, CB1, CB2, CB3.

The carrier 305 can be grasped by separating one or both of the handle flaps 363 at the respective cuts 367 and folding the respective handle flaps 363 downwardly at the respective fold lines 365 toward the respective openings 230 such that a user can insert one or more fingers therethrough to grasp a portion of the carrier 305, for example, an underside of the top panel 259 and/or the attachment panels 231*a*, 231*b*. The alignment of the respective handle openings 230 below the respective handle features in the top panel 259, e.g., handle flaps 363, in the erected carrier 305 provides a space through which the user's fingers can extend below the top panel 259 into an interior portion of the carrier 305. The handle flaps 363 are configured to at least partially fold at one or both of the respective fold lines 369, 371, for example, to at least partially conform around a respective container CA1, CA2, CA3, CB1, CB2, CB3.

The configuration of the carrier 305/package 310 provides a compact and robust holding and carrying structure for the containers CA1, CA2, CA3, CB1, CB2, CB3, with the advantages described above with respect to the carrier 205/package 210.

Figure 11:
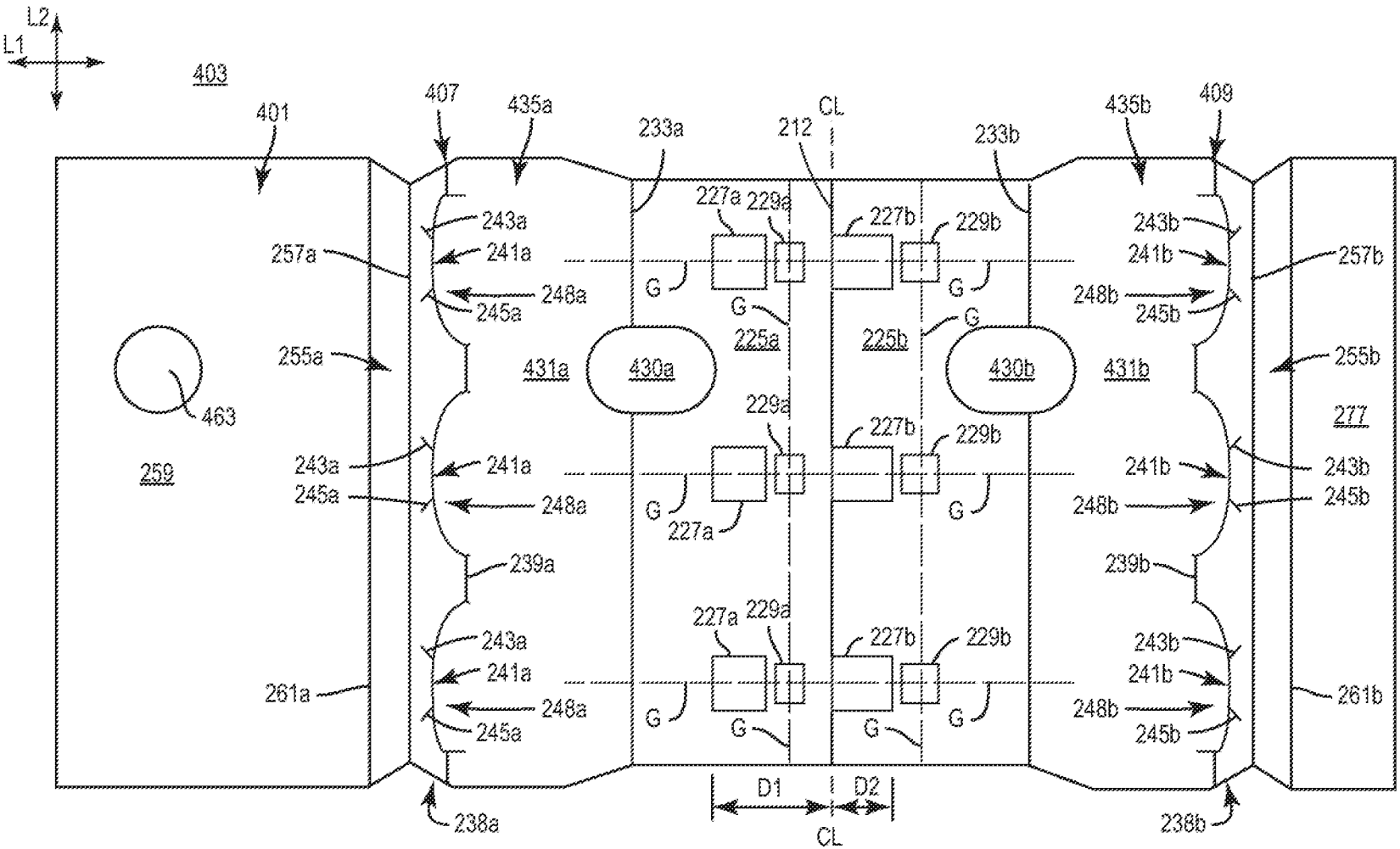
FIG. 11 is a plan view of an outer surface of a blank for forming a carrier according to a third exemplary embodiment of the disclosure.
Figure 15:
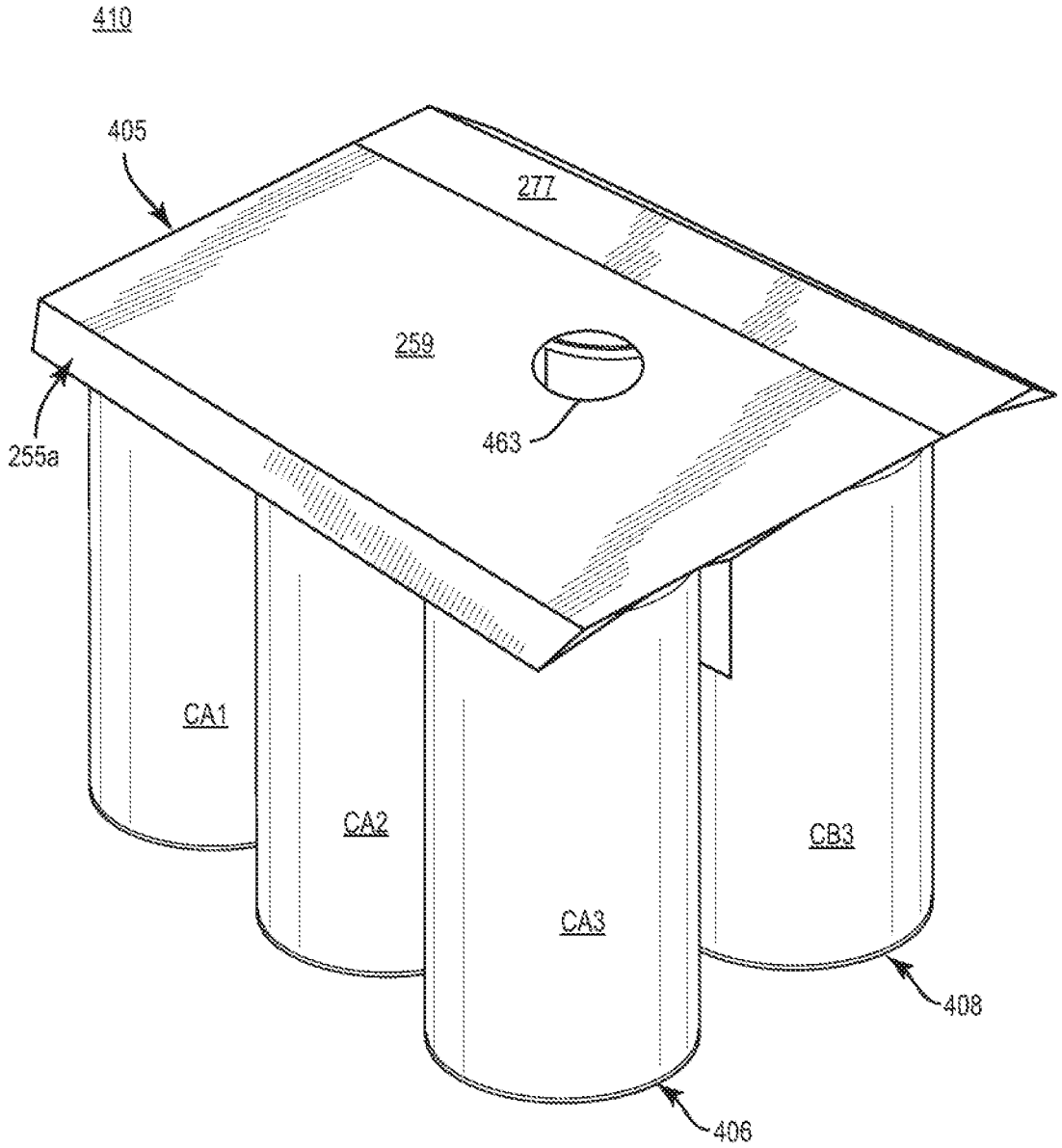
FIG. 15 is a perspective view of a package and carrier formed from the blank of FIG. 11 according to the third exemplary embodiment.

FIG. 11 is a plan view of the exterior side 401 of a blank, generally indicated at 403, used to form a carrier 405 (FIG. 15) for containing one or more containers according to a third exemplary embodiment of the disclosure. The blank 403 and the carrier 405 formed therefrom can have one or more substantially similar features to the blanks 203, 303 (FIGS. 1 and 6) and the carriers 205, 305 (FIGS. 5 and 10) described above, and like or similar components are referenced with like or similar reference numbers.

As shown, the blank 403 includes a front portion 407 and a back portion 409 and includes container retention features such that respective container retention portions 435*a*, 435*b* are configured to engage and support three containers in the front portion 406 of the carrier 405 and three containers in the back portion 408 of the carrier 405 formed from the blank 403. The central panels 225*a*, 225*b* of the blank 403 are each partitioned by respective handle openings 430*a*, 430*b* (broadly, respective "first handle opening" and "second handle opening") that extend from each respective central panel 225*a*, 225*b* into the respective attachment panels 431*a*, 431*b*.

The respective container retention portions 435*a*, 435*b* of the respective attachment panels 431*a*, 431*b* include the respective lateral fold lines 239*a*, 239*b*, interrupted by the respective cuts 241*a*, 243*a*, 245*a* and 241*b*, 243*b*, 245*b* that can form a plurality of flexible edges in the respective container retention portions 235*a*, 235*b* for engaging top portions of respective containers, as well as defining the container retention tabs 248*a*, 248*b* that extend away from the respective container retention portions 235*a*, 235*b*. As shown, an exterior marginal portion 438*a* of the attachment panel 431*a* is defined between the fold line 239*a* and the lateral fold line 257*a* adjacent the attachment panel 431*a*.

As shown, the top panel 259 of the blank 403 includes handle features that include a top handle opening 463 that is laterally aligned with the respective handle openings 430*a*, 430*b*. Handle features of the carrier 405 include the handle features in the top panel 259, and can also include the handle openings 430*a*, 430*b*. The carrier 405 can have a different arrangement of handle features, or can be devoid of handle features, without departing from the disclosure.

As also shown, glue G can be applied to one or more portions of the central panels 225*a*, 225*b*, e.g., across the respective surface features 229*a*, 229*b*. While the glue G is illustrated on the exterior surface 401 of the blank 403 in FIG. 11 for clarity of illustration and to indicate positioning relative to other features of the blank 403, it will be understood that the glue G is applied to at least the interior surface of the central panels 225*a*, 225*b*. In one embodiment, glue G can be applied to both the interior surface and the exterior surface of the central panels 225*a*, 225*b*.

Referring additionally to FIGS. 12-15, formation of the carrier 405 from the blank 403 and an associated package 410 that includes the containers CA1, CA2, CA3, CB1, CB2, CB3 is illustrated according to one exemplary embodiment of the disclosure. It will be understood that the carrier 405 can be formed in a similar manner to that of the carriers 205, 305 described above and is provided with at least similar properties and advantages.

Figure 12:
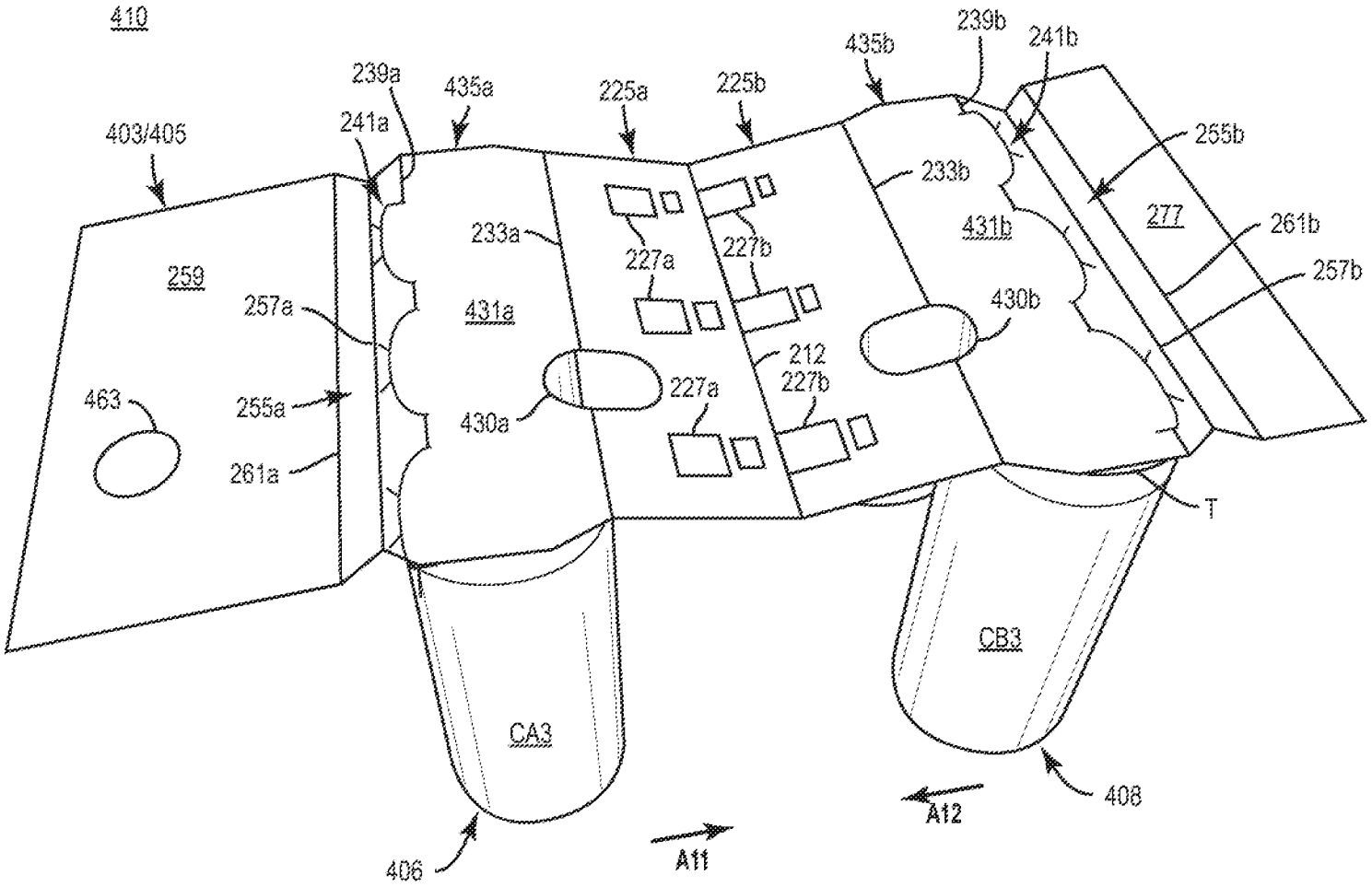
FIG. 12 is a perspective view of a partially folded configuration of a carrier formed from the blank of FIG. 11 according to the third exemplary embodiment.
Figure 13:
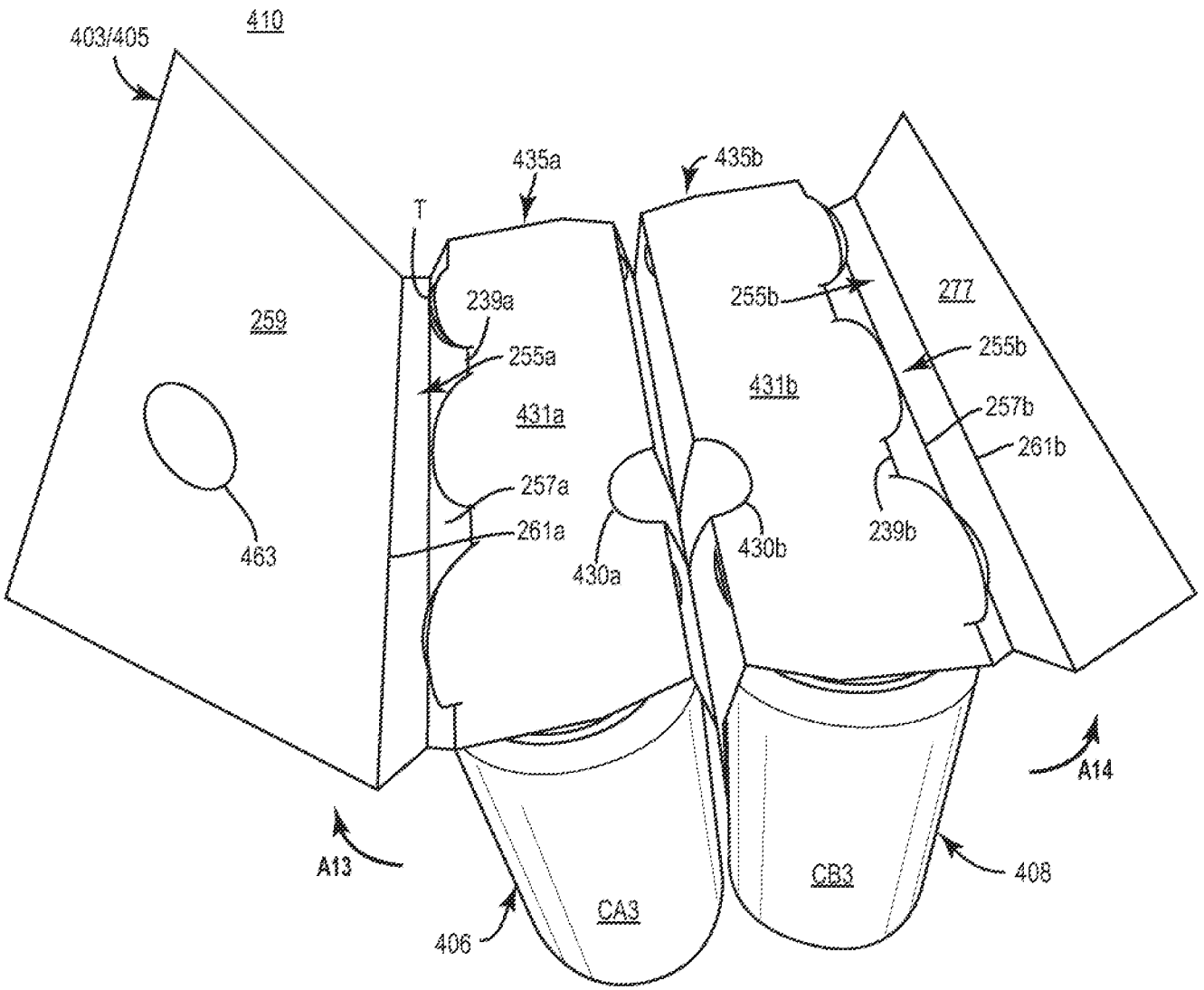
FIG. 13 is a perspective view of another partially folded configuration of a carrier formed from the blank of FIG. 11 according to the third exemplary embodiment.

As shown in FIG. 12 (in which the glue G is omitted for clarity of illustration), the exterior surface 401 of the blank 403 can be placed atop the containers CA1, CA2, CB1, CB2, CB3 such that the container retention portion 435*a* of the front attachment panel 431*a* overlies the containers CA1, CA2, CA3 and such that the container retention portion 435*b* of the back attachment panel 431*b* overlies the containers CB1, CB2, CB3. Further downward positioning of the attachment panels 431*a*, 431*b* over the plurality of containers CA1, CA2, CA3, CB1, CB2, CB3 can activate the respective container retention portions 435*a*, 435*b* to engage respective containers. For example, as the front attachment panel 431*a* is lowered or urged downwardly onto the containers CA1, CA2, CA3 the container retention portion 435*a* can at least partially separate from the remainder of the front attachment panel 431*a* at the cuts 241*a* such that an upper or top portion T of the respective containers CA1, CA2, CA3 can at least partially protrude through respective openings formed by the respective cuts 241*a*. Such reconfiguration of the corresponding portions of the back attachment panel 431*b* can occur as the back attachment panel 431*b* is lowed or urged downwardly onto the containers CB1, CB2, CB3. The marginal portion 438*a* of the attachment panel 431*a* can fold at least partially downwardly at the fold line 239*a* in such a configuration, and, similarly, the marginal portion 238*b* of the attachment panel 231*b* can fold at least partially downwardly at the fold line 239*b*.

In this regard, portions of the container retention portion 435*a*, e.g., the container retention tabs 438*a*, can engage one or more portions of the respective containers CA1, CA2, CA3, for example, an edge presented by a rim or top portion T of the respective containers CA1, CA2, CA3. It will be understood that other portions of the front attachment panel 231*a* can form a portion of the container retention portion 435*a*, for example, a portion of the front attachment panel 431*a* disposed between and/or adjacent the respective cuts 243*a*, 245*a*, which can engage an edge presented by the rim or top portion T of the respective containers CA1, CA2, CA3 as described above. The back attachment panel 431*b* and corresponding container retention portion 435*b* can engage the containers CB1, CB2, CB3 in a similar manner as described above with respect to the engagement of the front attachment panel 431*a* and container retention portion 435*a* with respect to the containers CA1, CA2, CA3.

The front central panel 225*a* and the back central panel 225*b* can be folded at the fold line 212 and brought into at least partial face-to-face contact in the direction of the respective arrows A11, A12, and such that the respective glue openings 227*a*, 227*b* are in general alignment and positioned so as to be laterally aligned but longitudinally offset. In this regard, the central panels 225*a*, 225*b* are arranged such that a portion of the front central panel 225*a* overlaps each of the glue openings 227*b* and a portion of the back central panel 225*b* overlaps each of the glue openings 227*a* to provide communication between the central panels 225*a*, 225*b* and respective surfaces upon which the respective containers CA1, CA2, CA3 and CB1, CB2, CB3 can be adhered or otherwise attached, as described further herein.

Figure 14:
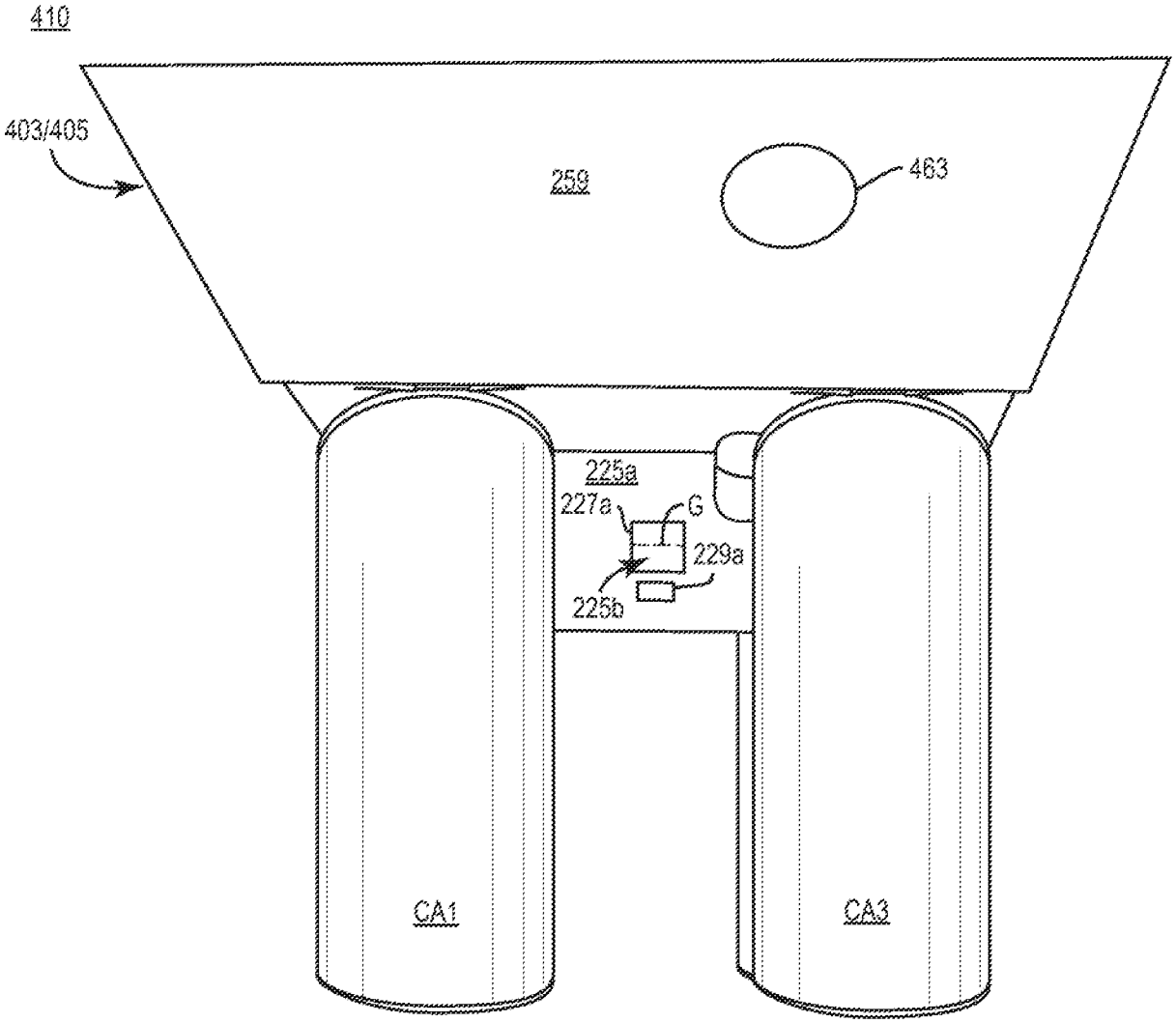
FIG. 14 is a perspective view of another partially folded configuration of a carrier formed from the blank of FIG. 11 according to the third exemplary embodiment and having a pair of containers removed.

As shown in FIG. 14, in which the containers CA2, CB2 are removed for clarity of illustration, glue G can be provided in alignment with the glue openings 227*a* to adhere the containers CA1, CA2, CA3 to respective exposed portions of the central panel 225*b* through the respective glue openings 227*a*, and the glue G can be provided in alignment with the glue openings 227*b* to adhere the containers CB1, CB2, CB3 to respective exposed portions of the central panel 225*a* through the respective glue openings 227*b*. The glue G can cover at least a portion of the surface features 229*a*, 229*b* such that one or more of the surface features 229*a*, 229*b* presents additional surfaces for adhesion and/or spacing between the front portion 206 and the back portion 408 of the carrier 405.

As described above, the adhesion of the containers of the front portion 406 of the carrier 405 to respective surfaces of the back central panel 225*b* exposed through the glue openings 227*a*, and the adhesion of the containers of the back portion 408 of the carrier 405 to respective surfaces of the front central panel 225*a* exposed through the glue openings 227*b* can provide compression between the central panels 225*a*, 225*b* and stability to the carrier 405. The containers can be attached to the respective central panels 225*a*, 225*b* in a different configuration as described above, e.g., a configuration in which the containers are not engaged by a container retention portion or a configuration in which a fewer number of or no glue openings are provided.

Still referring to FIGS. 12-15, the front side panel 255*a* can be folded upwardly at the fold line 257*a* in the direction of the arrow A13, for example, to be at an oblique arrangement relative to the containers CA1, CA2, CA3, CB1, CB2, CB3, and the top panel 259 can be folded at the fold line 261*a* in the direction of the arrow A13 into at least partial face-to-face contact with at least a portion of the attachment panels 431*a*, 431*b*. Similarly, the back side panel 255*b* can be folded upwardly at the fold line 257*b* in the direction of the arrow A14 into an oblique arrangement with the containers CA1, CA2, CA3, CB1, CB2, CB3, and the attachment flap 277 can be folded at the fold line 261*b* in the direction of the arrow A14 into at least partial face-to-face contact with the top panel 259 and/or the attachment panel 431*b*.

Accordingly, containers can be engaged by the respective attachment panels 431*a*, 431*b* and can extend below the respective container retention portions 435*a*, 435*b* in the assembled carrier 405/package 410. In such an arrangement, containers CA1, CA2, CA3 extend below the container retention portion 435*a* in the front portion 406 of the carrier 405, and containers CB1, CB2, CB3 extend below the container retention portion 435*b* in the back portion 408 of the carrier 405, with the top panel 259 and the attachment flap 277 overlying respective portions of the respective container retention portions 435*a*, 435*b*. Further, the front central panel 225*a* and the back central panel 225*b* are positioned between and attached to respective ones of the containers CA1, CA2, CA3, CB1, CB2, CB3.

A user can grasp the carrier 405 by inserting one or more fingers through the top handle opening 463 to grasp a portion of the carrier 405, for example, an underside of the top panel 259 and/or the attachment panels 431*a*, 431*b*. The alignment of the handle openings 430*a*, 430*b* below the handle feature in the top panel 259, e.g., the top handle opening 463, in the erected carrier 405 provides a space through which the user's fingers can extend below the top panel 259 into an interior portion of the carrier 405.

The configuration of the carrier 405/package 410 provides a compact and robust holding and carrying structure for the containers CA1, CA2, CA3, CB1, CB2, CB3, with the advantages described above with respect to the carrier 205/package 210 and the carrier 305/package 310.

Figure 16:
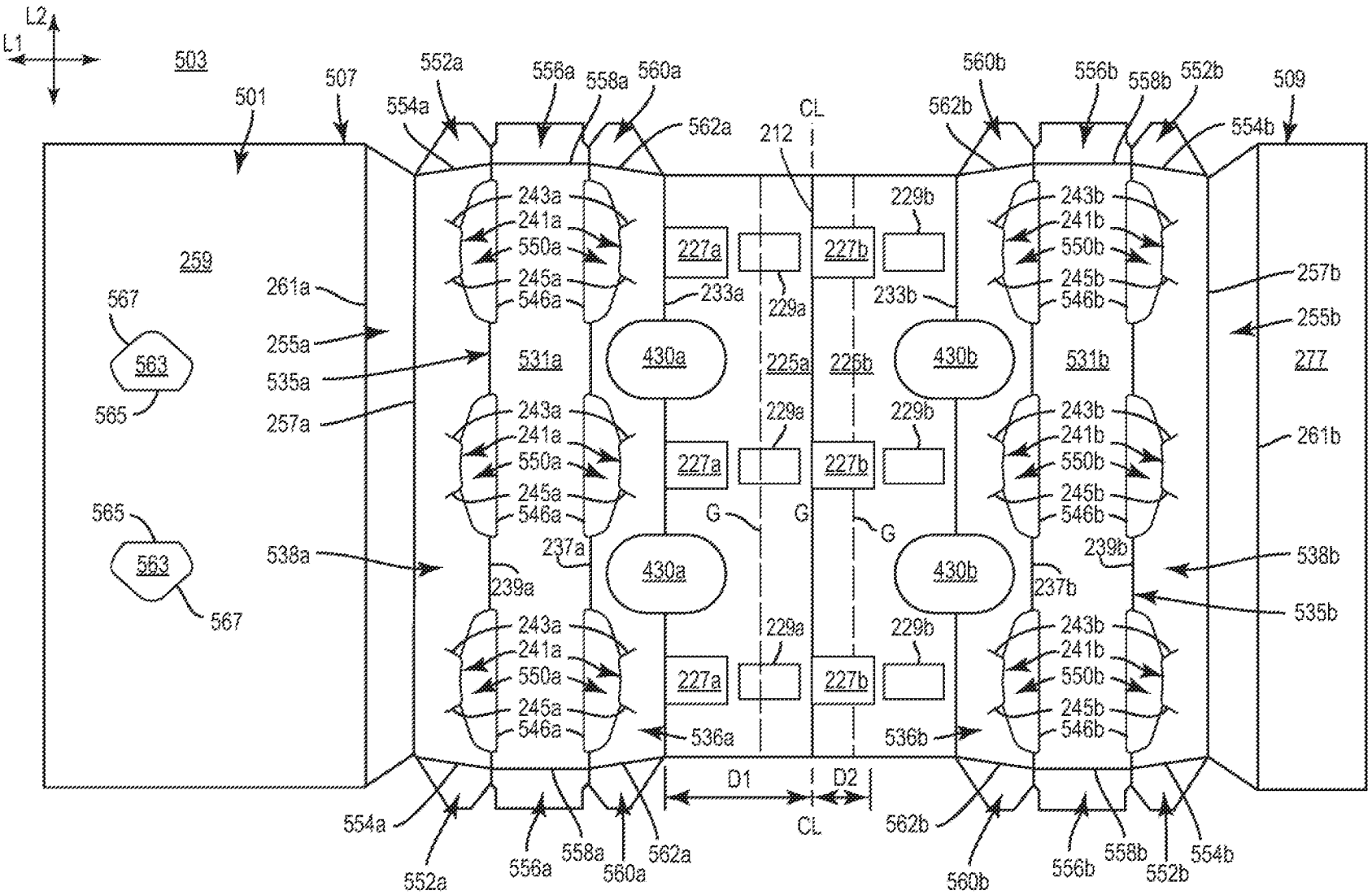
FIG. 16 is a plan view of an outer surface of a blank for forming a carrier according to a fourth exemplary embodiment of the disclosure.
Figure 21:
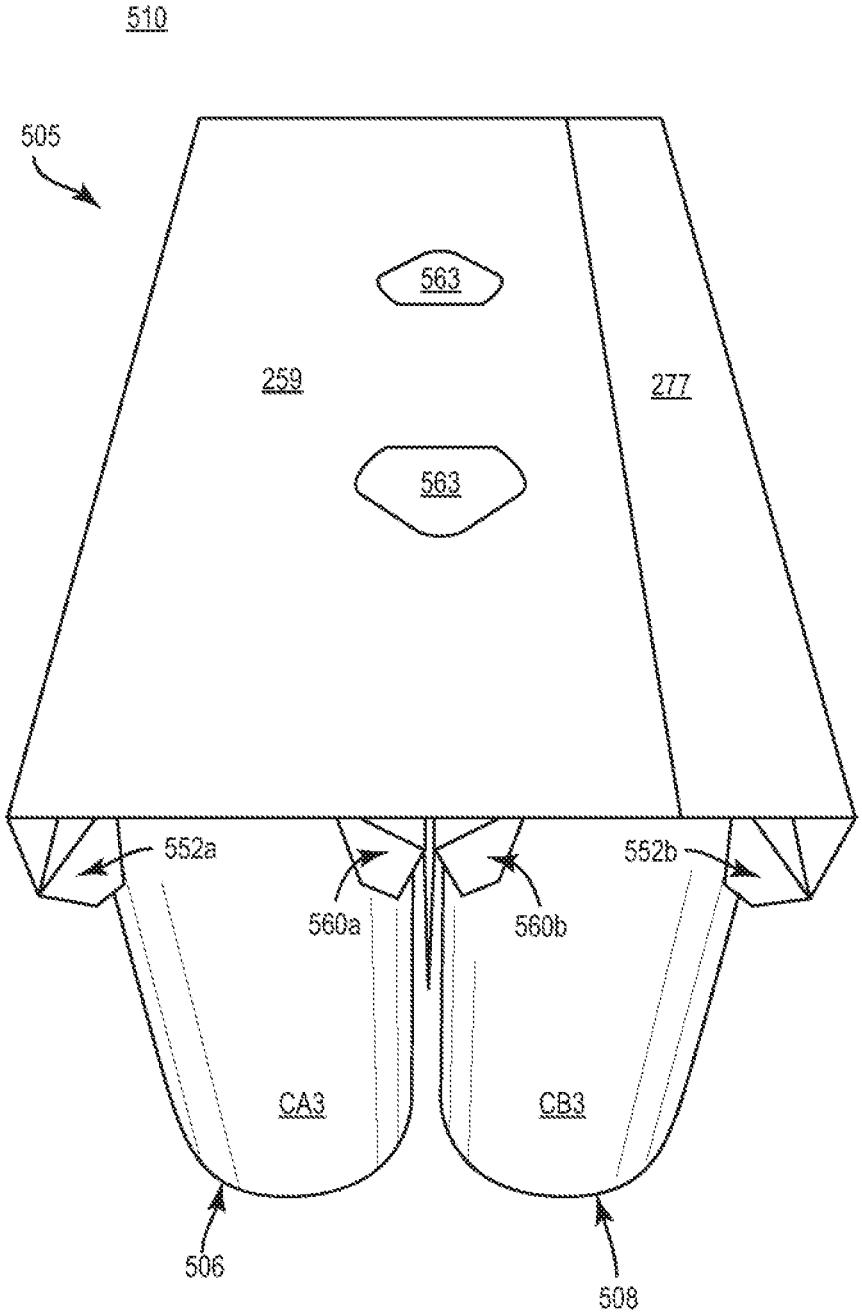
FIG. 21 is a perspective view of a package and carrier formed from the blank of FIG. 16 according to the fourth exemplary embodiment.
Figure 22:
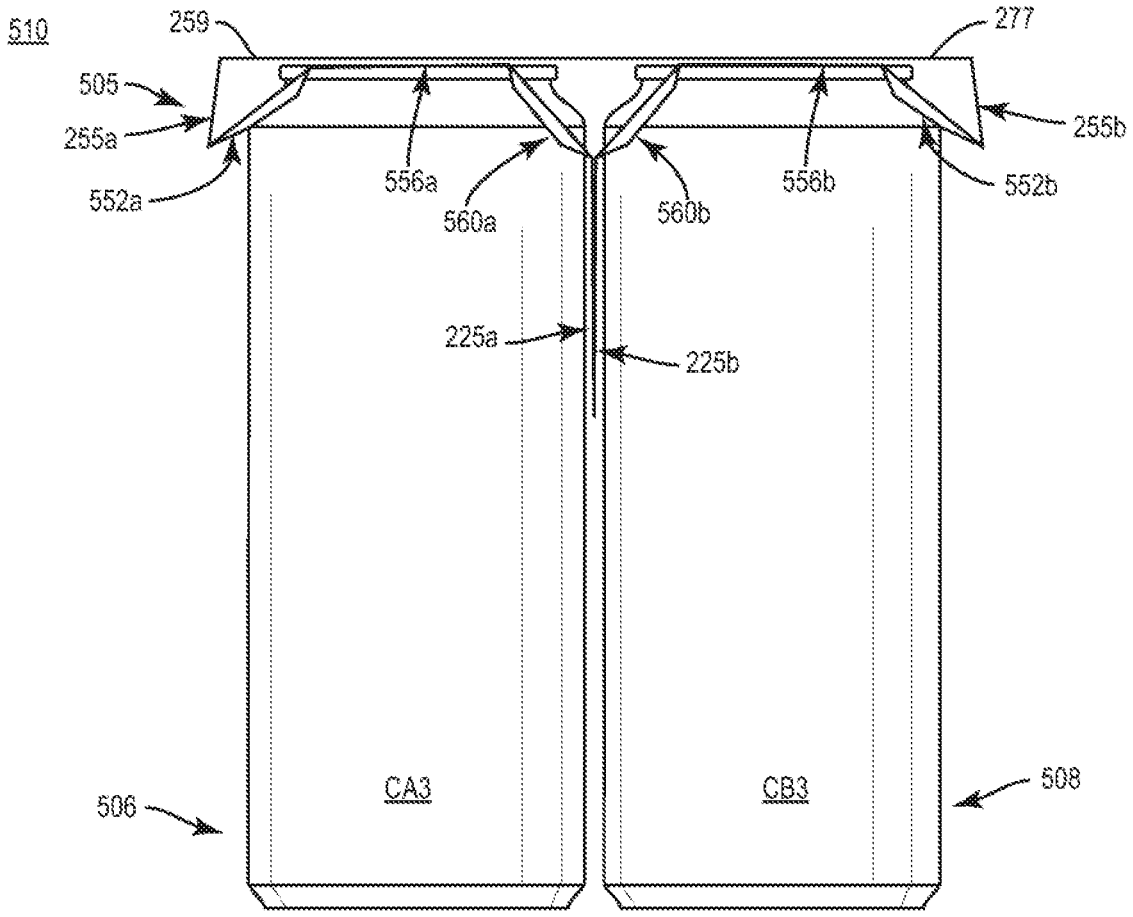
FIG. 22 is a side view of the package and carrier of FIG. 21.
Figure 23:
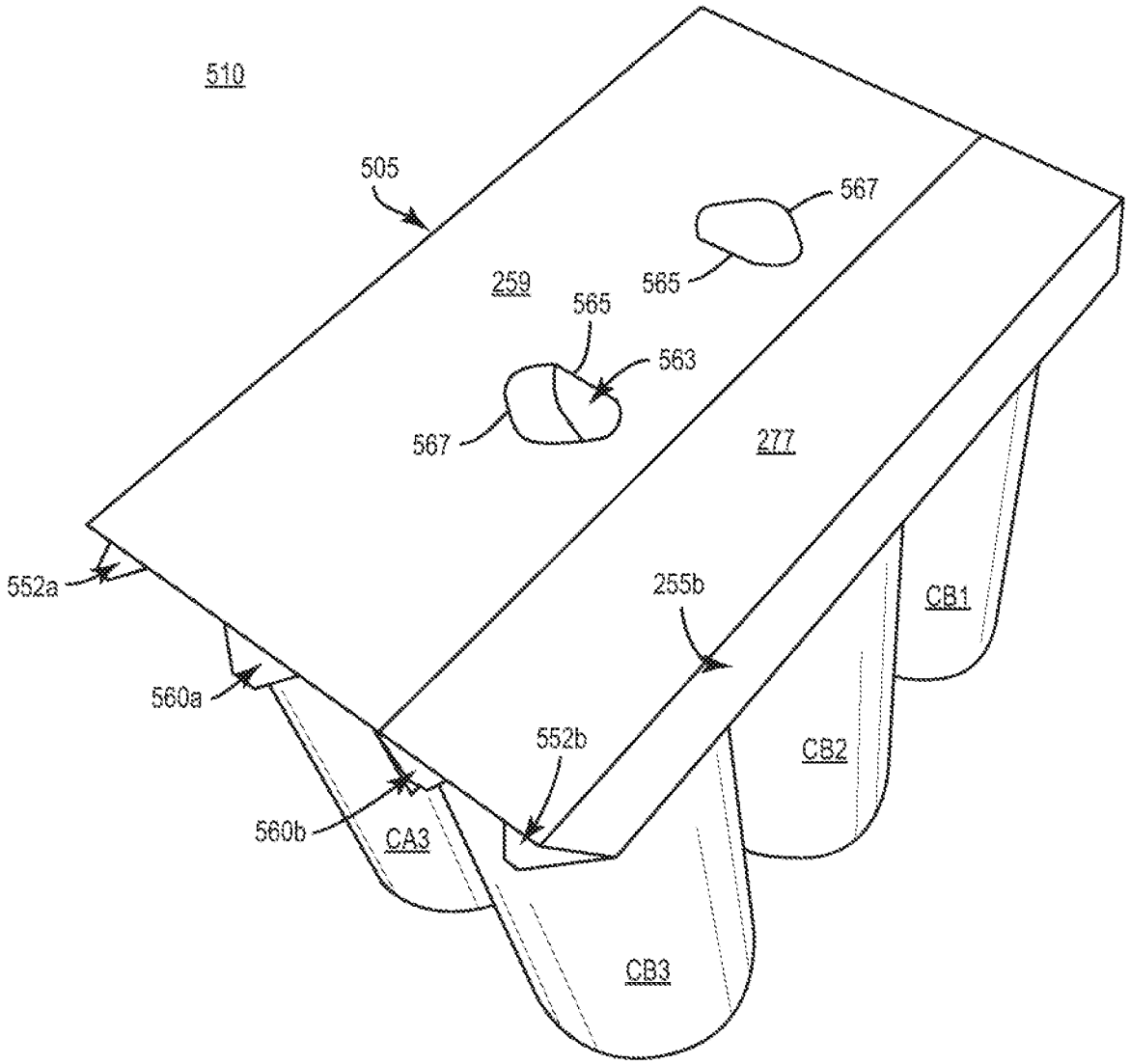
FIG. 23 is another perspective view of the package and carrier of FIG. 21.

FIG. 16 is a plan view of the exterior side 501 of a blank, generally indicated at 503, used to form a carrier 505 (FIG. 21) for containing one or more containers according to a fourth exemplary embodiment of the disclosure. The blank 503 and the carrier 505 formed therefrom can have one or more substantially similar features to the blanks 203, 303, 403 and the carriers 205, 305, 405 described above, and like or similar components are referenced with like or similar reference numbers.

As shown, the blank 503 includes a front portion 507 and a back portion 509 and includes container retention features such that respective container retention portions 535*a*, 535*b* are configured to engage and support three containers in the front portion 506 of the carrier 505 and three containers in the back portion 508 of the carrier 505 formed from the blank 503. The central panels 225*a*, 225*b* of the blank 503 are each partitioned by respective pairs of openings 430*a*, 430*b* that extend from each respective central panel 225*a*, 225*b* into the respective attachment panels 531*a*, 531*b*.

As shown, the respective container retention portions 535*a*, 535*b* of the respective attachment panels 531*a*, 531*b* include the respective lateral fold lines 237*a*, 239*a* and 237*b*, 239*b*, interrupted by the respective cuts 241*a*, 243*a*, 245*a* and 241*b*, 243*b*, 245*b* that can form a plurality of flexible edges in the respective container retention portions. As shown, endpoints of the respective cuts 241*a*, 241*a* are connected by additional respective cuts 546*a*, 546*b* to form respective container retention openings 550*a*, 550*b* therebetween. In this regard, the container retention portions 543*a*, 543*b* are arranged to receive a portion of respective containers CA1, CA2, CA3 and CB1, CB2, CB3, e.g., a rim or top portion T thereof, through portions of the respective container retention openings 550*a*, 550*b*. As also shown, an interior marginal portion 536*a* of the attachment panel 531*a* is defined between the fold lines 237*a*, 233*a*, and an exterior marginal portion 538*a* of the attachment panel 531*a* is defined between the fold line 239*a* and a lateral fold line 257*a* adjacent the attachment panel 531*a*.

Further, the container retention features include a plurality of end flaps foldably connected to the respective container retention portions 535*a*, 535*b*, including first end flaps 552*a*, 552*b* foldably connected to laterally-opposed sides of the respective container retention portions 535*a*, 535*b* at respective oblique fold lines 554*a*, 554*b*, respective second end flaps 560*a*, 560*b* foldably connected to laterally-opposed sides of the respective container retention portions 535*a*, 535*b* at respective oblique fold lines 562*a*, 562*b*, and respective third end flaps 556*a*, 556*b* foldably connected to laterally-opposed sides of the respective container retention portions 535*a*, 535*b* at respective longitudinal fold lines 558*a*, 558*b*. The respective end flaps 552*a*, 556*a* and 552*b*, 556*b* are foldably connected to one another at respective portions of the respective fold lines 239*a*, 239*b* and the respective end flaps 556*a*, 560*a* and 556*b*, 560*b* are foldably connected to one another at respective portions of the respective fold lines 237*a*, 237*b*.

As shown, the top panel 259 of the blank 503 includes handle features that include a pair of handle flaps 563 (broadly, respective "first handle feature" and "second handle feature") that are foldably connected to the top panel 259 at respective longitudinal fold lines 565 and that are defined by respective cuts 567 that extend from one endpoint of the respective fold lines 565 to the other respective endpoint. Handle features of the carrier 505 include the handle features in the top panel 259, and can also include the handle openings 430*a*, 430*b*. The carrier 405 can have a different arrangement of handle features, or can be devoid of handle features, without departing from the disclosure.

As also shown, glue G can be applied to one or more portions of the central panels 225*a*, 225*b*, e.g., across the respective surface features 229*a*, 229*b*. While the glue G is illustrated on the exterior surface 501 of the blank 503 in FIG. 16 for clarity of illustration and to indicate positioning relative to other features of the blank 503, it will be understood that the glue G is applied to at least the interior surface of the central panels 225*a*, 225*b*. In one embodiment, glue G can be applied to both the interior surface and the exterior surface of the central panels 225*a*, 225*b*.

Referring additionally to FIGS. 17-23, formation of the carrier 505 from the blank 503 and an associated package 510 that includes the containers CA1, CA2, CA3, CB1, CB2, CB3 is illustrated according to one exemplary embodiment of the disclosure. It will be understood that the carrier 505 can be formed in a similar manner to that of the carriers 205, 305, 405 described above, and is provided with at least similar properties and advantages.

Figure 17:
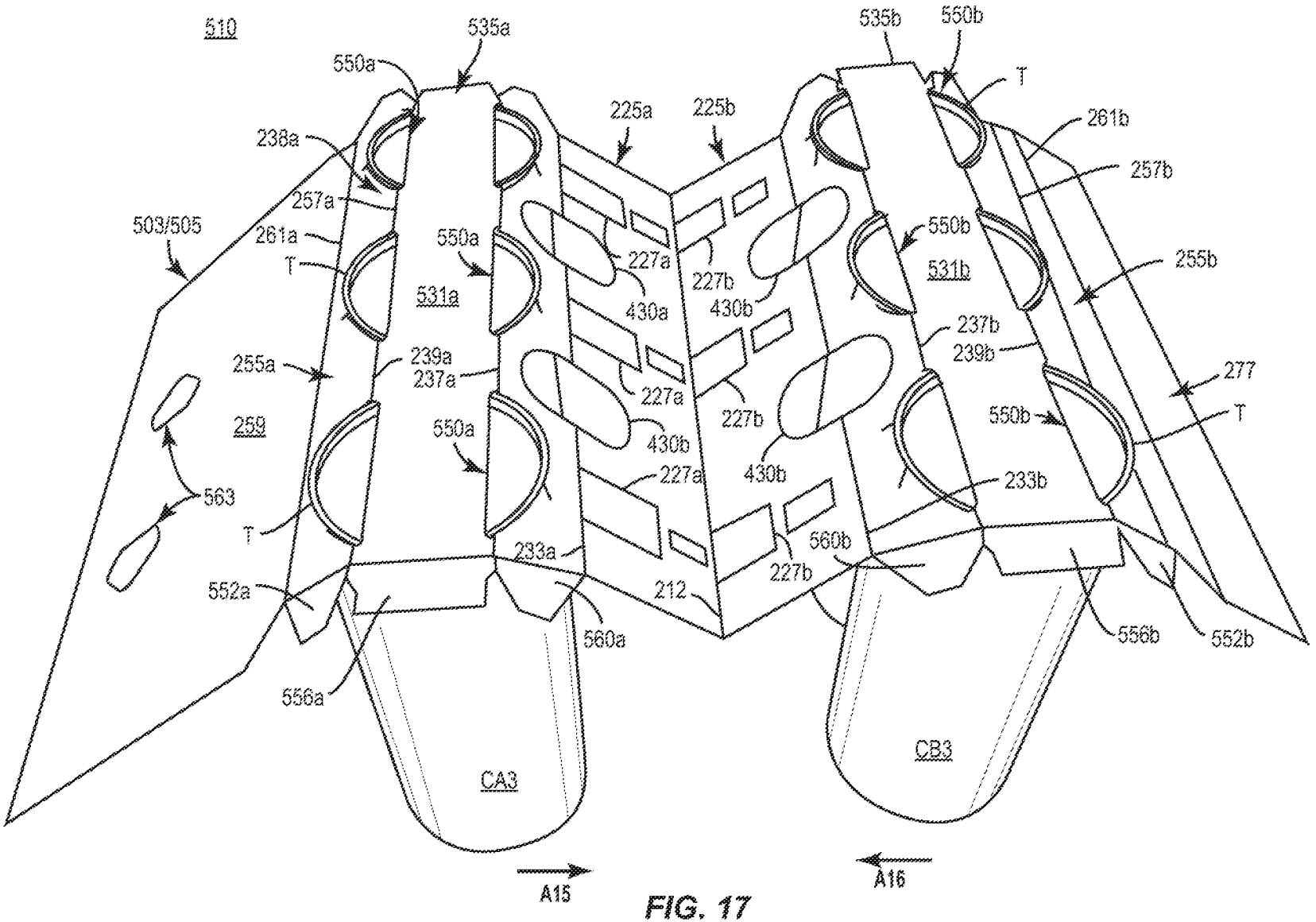
FIG. 17 is a perspective view of a partially folded configuration of a carrier formed from the blank of FIG. 16 according to the fourth exemplary embodiment.
Figure 18:
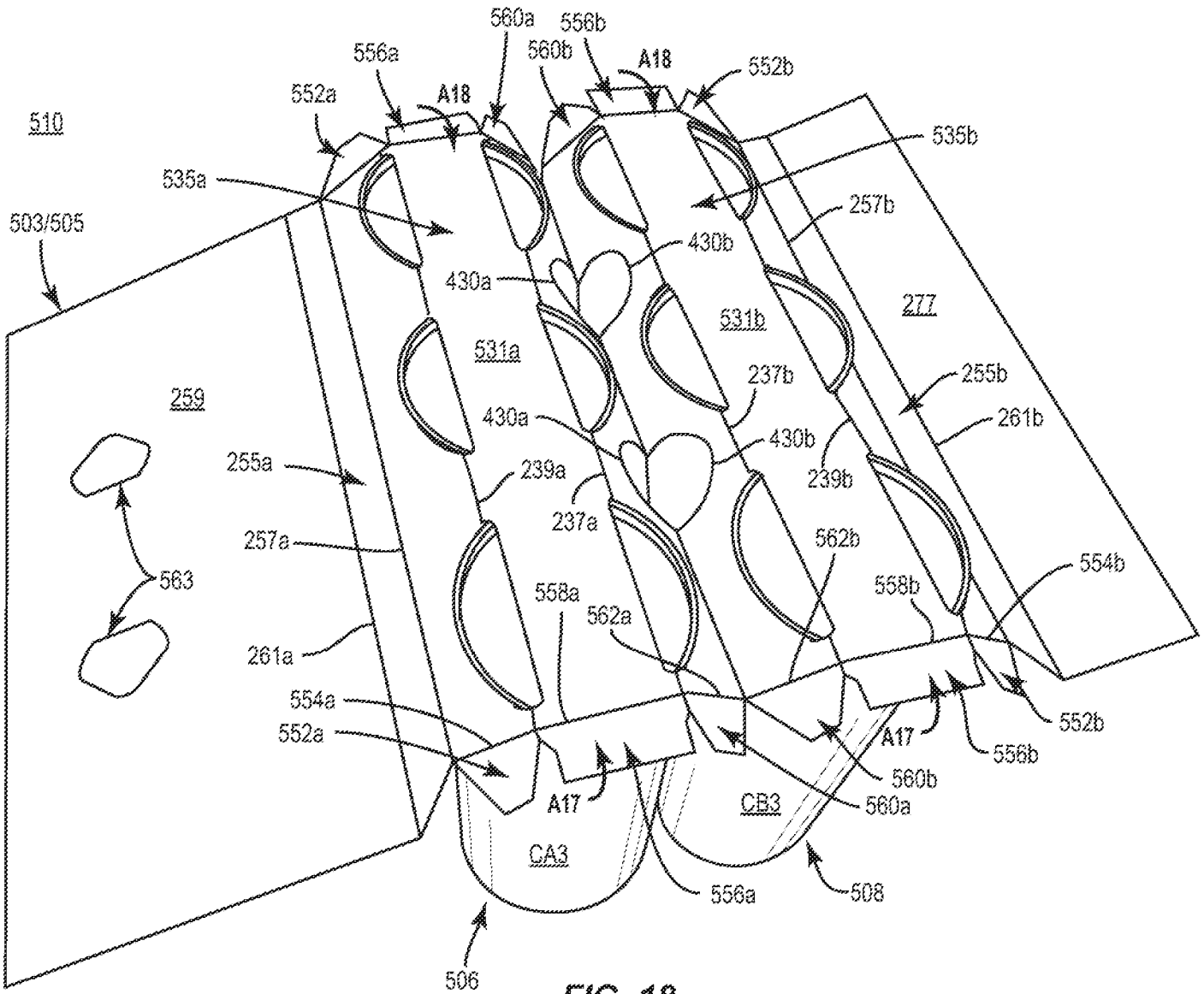
FIG. 18 is a perspective view of another partially folded configuration of a carrier formed from the blank of FIG. 16 according to the fourth exemplary embodiment.

As shown in FIG. 17 (in which the glue G is omitted for clarity of illustration), the exterior surface 501 of the blank 503 can be placed atop the containers CA1, CA2, CB1, CB2, CB3 such that the container retention portion 535*a* of the front attachment panel 531*a* overlies the containers CA1, CA2, CA3 and such that the container retention portion 535*b* of the back attachment panel 531*b* overlies the containers CB1, CB2, CB3. Further downward positioning of the attachment panels 531*a*, 531*b* over the plurality of containers CA1, CA2, CA3, CB1, CB2, CB3 can activate the respective container retention portions 535*a*, 535*b* to engage respective containers. For example, as the front attachment panel 531*a* is lowered or urged downwardly onto the containers CA1, CA2, CA3, an upper or top portion T of the respective containers CA1, CA2, CA3 can at least partially protrude through the respective openings 550*a* formed by the respective cuts 241*a*, 546*a*. Such engagement of the corresponding portions of the back attachment panel 531*b* can occur as the back attachment panel 531*b* is lowed or urged downwardly onto the containers CB1, CB2, CB3. The marginal portions 536*a*, 538*a* of the attachment panel 531*a* can fold at least partially downwardly at the respective fold lines 237*a*, 239*a* in such a configuration, and, similarly, the marginal portions 536*b*, 538*b* of the attachment panel 531*b* can fold at least partially downwardly at the respective fold lines 237*b*, 239*b*.

In this regard, portions of the container retention portion 535*a*, e.g., portions of the attachment panel 531*a* adjacent the respective openings 550*a*, can engage one or more portions of the respective containers CA1, CA2, CA3, for example, an edge presented by a rim or top portion T of the respective containers CA1, CA2, CA3. It will be understood that other portions of the front attachment panel 531*a* can form a portion of the container retention portion 535*a*, for example, a portion of the front attachment panel 531*a* disposed between and/or adjacent the respective cuts 243*a*, 245*a*, which can engage an edge presented by the rim or top portion T of the respective containers CA1, CA2, CA3 as described above. The back attachment panel 531*b* and corresponding container retention portion 535*b* can engage the containers CB1, CB2, CB3 in a similar manner as described above with respect to the engagement of the front attachment panel 531*a* and container retention portion 535*a* with respect to the containers CA1, CA2, CA3.

The front central panel 225*a* and the back central panel 225*b* can be folded at the fold line 212 and brought into at least partial face-to-face contact in the direction of the respective arrows A15, A16, and such that the respective glue openings 227*a*, 227*b* are in general alignment and positioned so as to be laterally aligned but longitudinally offset. In this regard, the central panels 225*a*, 225*b* are arranged such that a portion of the front central panel 225*a* overlaps each of the glue openings 227*b* and a portion of the back central panel 225*b* overlaps each of the glue openings 227*a* to provide communication between the central panels 225*a*, 225*b* and respective surfaces upon which the respective containers CA1, CA2, CA3 and CB1, CB2, CB3 can be adhered or otherwise attached, as described further herein.

Figure 19:
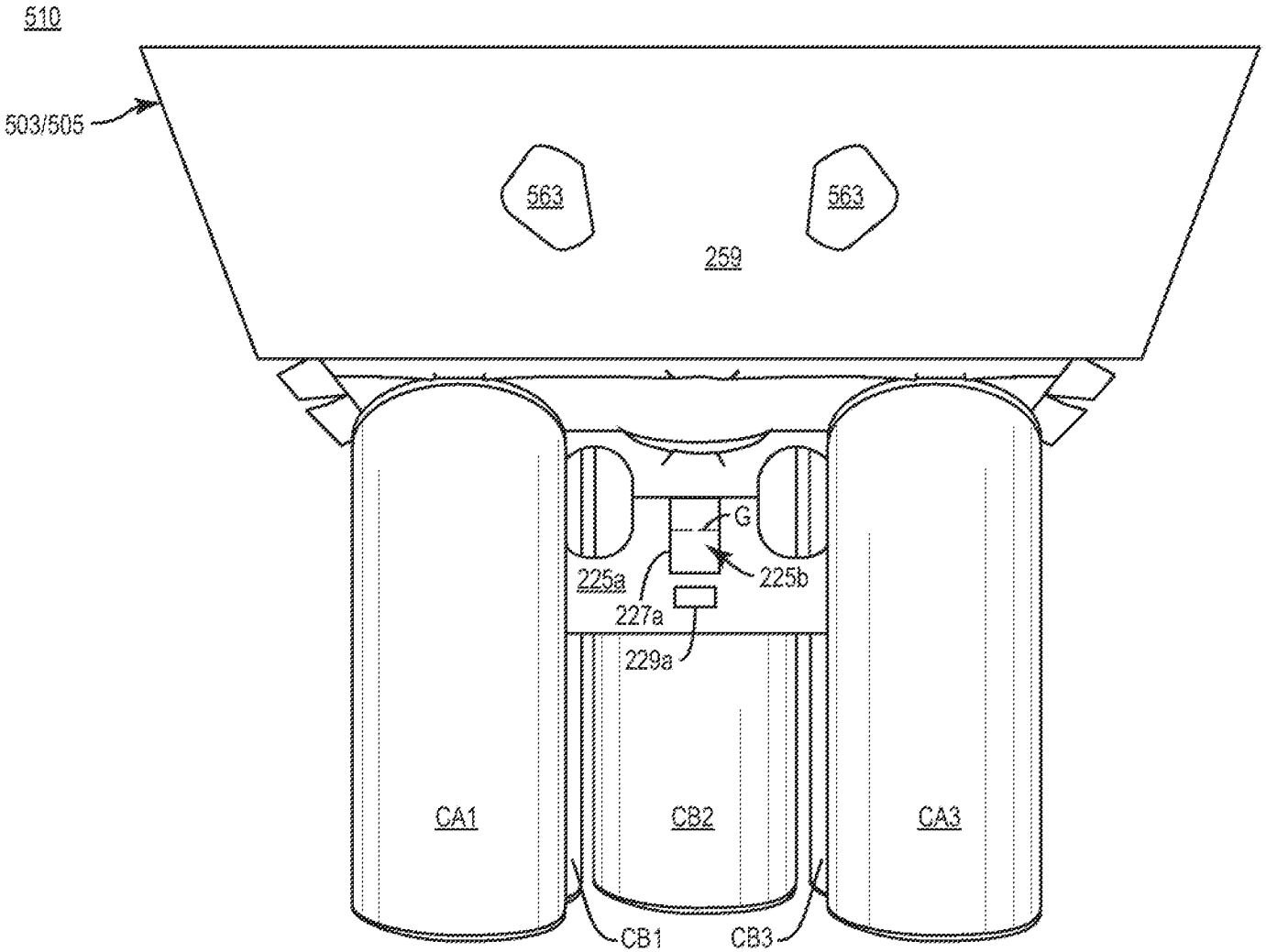
FIG. 19 is a perspective view of another partially folded configuration of a carrier formed from the blank of FIG. 16 according to the fourth exemplary embodiment and having a container removed.
Figure 20:
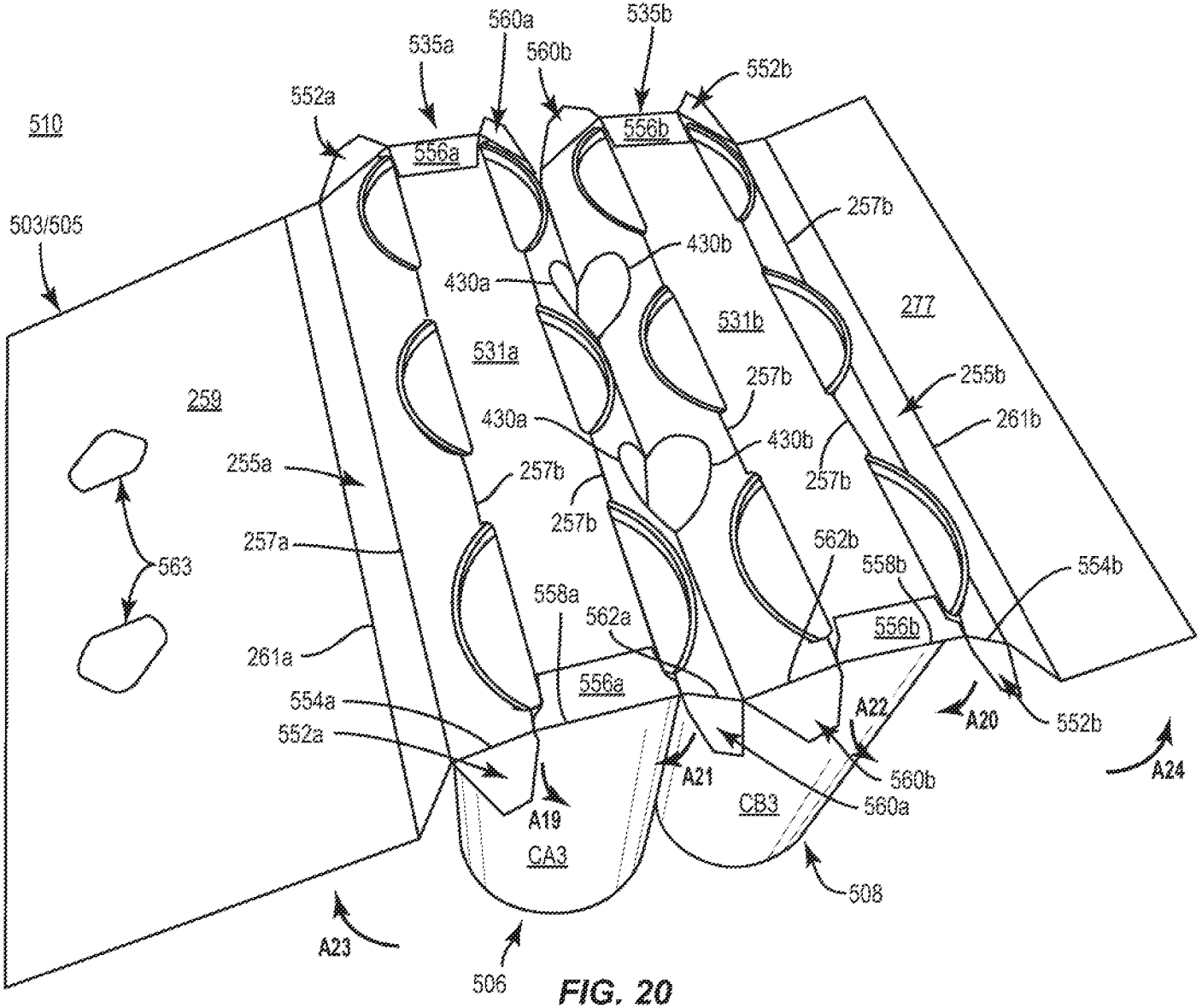
FIG. 20 is another perspective view of another partially folded configuration of a carrier formed from the blank of FIG. 16 according to the fourth exemplary embodiment.

As shown in FIG. 19, in which the container CA2 is removed for clarity of illustration, glue G can be provided in alignment with the glue openings 227*a* to adhere the containers CA1, CA2, CA3 to respective exposed portions of the central panel 225*b* through the respective glue openings 227*a*, and the glue G can be provided in alignment with the glue openings 227*b* to adhere the containers CB1, CB2, CB3 to respective exposed portions of the central panel 225*a* through the respective glue openings 227*b*. In one embodiment, the glue G can cover at least a portion of the surface features 229*a*, 229*b* such that one or more of the surface features 229*a*, 229*b* presents additional surfaces for adhesion and/or spacing between the front portion 506 and the back portion 508 of the carrier 505.

As described above, the adhesion of the containers of the front portion 506 of the carrier 505 to respective surfaces of the back central panel 225*b* exposed through the glue openings 227*a*, and the adhesion of the containers of the back portion 508 of the carrier 505 to respective surfaces of the front central panel 225*a* exposed through the glue openings 227*b* can provide compression between the central panels 225*a*, 225*b* and stability to the carrier 505. The containers can be attached to the respective central panels 225*a*, 225*b* in a different configuration as described above, e.g., a configuration in which the containers are not engaged by a container retention portion or a configuration in which a fewer number of or no glue openings are provided.

Additionally, and as shown, the respective end flaps 556*a*, 556*b* can be folded upwardly at the respective fold lines 558*a*, 558*b* in the direction of the arrows A17, A18 into overlapping and/or face-to-face contact with the respective container retention portions 535*a*, 535*b* of the respective attachment panels 531*a*, 531*b*. Such movement of the respective end flaps 556*a*, 556*b* urges the respective end flaps 552*a*, 552*b* to fold downwardly away from the respective attachment panels 531*a*, 531*b* at the respective fold lines 554*a*, 554*b* and to fold inwardly toward the respective end flaps 556*a*, 556*b* at the respective fold lines 239*a*, 239*b* in the direction of the respective arrows A19, A20 and causes the respective end flaps 560*a*, 560*b* to fold downwardly away from the respective attachment panels 531*a*, 531*b* at the respective fold lines 562*a*, 562*b* and to fold inwardly toward the respective end flaps 556*a*, 556*b* at the respective fold lines 237*a*, 237*b* in the direction of the respective arrows A21, A22. In such an arrangement, the respective end flaps 552*a*, 552*b*, 560*a*, 560*b* overlie longitudinally exterior-facing portions of the respective containers CA1, CA3, CB1, CB3.

Still referring to FIGS. 17-23, the front side panel 255*a* can be folded upwardly at the fold line 257*a* in the direction of the arrow A23, for example, to be at an oblique arrangement relative to the containers CA1, CA2, CA3, CB1, CB2, CB3, and the top panel 259 can be folded at the fold line 261*a* in the direction of the arrow A23 into at least partial face-to-face contact with at least a portion of the attachment panels 531*a*, 531*b*. Similarly, the back side panel 255*b* can be folded upwardly at the fold line 257*b* in the direction of the arrow A24 into an oblique arrangement with the containers CA1, CA2, CA3, CB1, CB2, CB3, and the attachment flap 277 can be folded at the fold line 261*b* in the direction of the arrow A24 into at least partial face-to-face contact with the top panel 259 and/or the attachment panel 531*b*.

Accordingly, containers can be engaged by the respective attachment panels 531*a*, 531*b* and can extend below the respective container retention portions 535*a*, 535*b* in the assembled carrier 505/package 510. In such an arrangement, containers CA1, CA2, CA3 extend below the container retention portion 535*a* in the front portion 506 of the carrier 505, and containers CB1, CB2, CB3 extend below the container retention portion 535*b* in the back portion 508 of the carrier 505, with the top panel 259 and the attachment flap 277 overlying respective portions of the respective container retention portions 535*a*, 535*b*. In such an arrangement, respective end flaps 552*a*, 556*a*, 560*a*, 552*b*, 556*b*, 560*b* are positioned to engage outward-facing portions of respective containers, for example, to provide enhanced engagement between the carrier 505 and the containers CA1, CA2, CA3, CB1, CB2, CB3. Further, the front central panel 225*a* and the back central panel 225*b* are positioned between and attached to respective ones of the containers CA1, CA2, CA3, CB1, CB2, CB3.

The carrier 505 can be grasped by separating one or both of the handle flaps 563 at the respective cuts 567 and folding the respective handle flaps 563 downwardly at the respective fold lines 565 toward the respective openings 430*a*, 430*b* such that a user can insert one or more fingers therethrough to grasp a portion of the carrier 505, for example, an underside of the top panel 259 and/or the attachment panels 531*a*, 531*b*. The alignment of the handle openings 430*a*, 430*b* below the handle flaps 563 in the erected carrier 505 provides a space through which the user's fingers can extend below the top panel 259 into an interior portion of the carrier 505.

The configuration of the carrier 505/package 510 provides a compact and robust holding and carrying structure for the containers CA1, CA2, CA3, CB1, CB2, CB3, with the advantages described above with respect to the carriers 205, 305, 405.

It will be understood that the blanks and carriers described herein can be provided in different configurations without departing from the disclosure.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels comprising a front central panel foldably connected to a back central panel at a lateral fold line, a front attachment panel foldably connected to the front central panel, and a back attachment panel foldably connected to the back central panel, each of the front attachment panel and the back attachment panel configured to receive a portion of one or more containers of the plurality of containers, each of the front central panel and the back central panel is for being positioned between and attached to adjacent containers of the plurality of containers, and each of the front central panel and the back central panel comprises an opening in communication with the respective other of the front central panel and the back central panel, the opening in the front central panel is spaced a first longitudinal distance from the lateral fold line, the opening in the back central panel is spaced a second longitudinal distance from the lateral fold line, the first longitudinal distance is greater than the second longitudinal distance such that the opening in the front central panel is offset from the opening in the back central panel.

2. The carrier of claim 1, wherein at least one of the front central panel and the back central panel is adhered to adjacent containers of the plurality of containers.

3. The carrier of claim 1, wherein a face of the front central panel is in at least partial face-to-face contact with a face of the back central panel.

4. The carrier of claim 1, wherein at least one of the front attachment panel and the back attachment panel comprises a plurality of cuts that define edges for engaging respective containers of the plurality of containers.

5. The carrier of claim 4, wherein the plurality of cuts defines a respective plurality of container retention tabs.

6. The carrier of claim 4, wherein the plurality of cuts are for receiving at least a portion of respective containers of the plurality of containers therethrough.

7. The carrier of claim 1, wherein the plurality of panels further comprises a top panel overlying at least a portion of at least one of the front attachment panel and the back attachment panel.

8. The carrier of claim 7, wherein the top panel comprises at least one handle feature and the at least one of the front central panel and the back central panel comprises a handle opening, the at least one handle feature of the top panel is aligned with the handle opening.

9. The carrier of claim 8, wherein the at least one handle feature comprises a first handle feature and a second handle feature, and the handle opening comprises a first handle opening and a second handle opening.

10. The carrier of claim 7, wherein the plurality of panels further comprises a side panel.

11. The carrier of claim 10, wherein the side panel is a front side panel foldably connected to the front attachment panel, and the plurality of panels further comprises a back side panel foldably connected to the back attachment panel.

12. The carrier of claim 1, wherein at least one end flap is foldably connected to at least one of the front attachment panel and the back attachment panel.

13. The carrier of claim 12, wherein the at least one end flap is folded downwardly relative to the at least one of the front attachment panel and the back attachment panel to overlie a portion of a container of the plurality of containers.

14. The carrier of claim 13, wherein the at least one end flap is a first end flap, the carrier further comprises a second end flap foldably connected to the at least one of the front attachment panel and the back attachment panel and folded downwardly relative to the at least one of the front attachment panel and the back attachment panel to overlie a portion of the container of the plurality of containers, and the carrier further comprises a third end flap foldably connected to and at least partially overlying a portion of the at least one of the front attachment panel and the back attachment panel.

15. The carrier of claim 1, wherein at least one of the front attachment panel and the back attachment panel comprises a plurality of openings for at least partially receiving respective containers of the plurality of containers.

16. A blank for forming a carrier for holding a plurality of containers, the blank comprising:

a plurality of panels comprising a front central panel foldably connected to a back central panel at a lateral fold line, a front attachment panel foldably connected to the front central panel, and a back attachment panel foldably connected to the back central panel, each of the back attachment panel and the front attachment panel is configured to receive a portion of one or more containers of the plurality of containers, each of the front central panel and the back central panel is for being positioned between and attached to adjacent containers of the plurality of containers in the carrier formed from the blank, and each of the front central panel and the back central panel comprises an opening for being in communication with the respective other of the front central panel and the back central panel when the carrier is formed from the blank, the opening in the front central panel is spaced a first longitudinal distance from the lateral fold line, the opening in the back central panel is spaced a second longitudinal distance from the lateral fold line, the first longitudinal distance is greater than the second longitudinal distance.

17. The blank of claim 16, wherein at least one of the front central panel and the back central panel is for being adhered to adjacent containers of the plurality of containers in the carrier formed from the blank.

18. The blank of claim 16, wherein at least one of the front attachment panel and the back central panel comprises a plurality of cuts that define edges for engaging respective containers of the plurality of containers in the carrier formed from the blank.

19. The blank of claim 18, wherein the plurality of cuts defines a respective plurality of container retention tabs.

20. The blank of claim 16, wherein the plurality of panels further comprises a top panel.

21. The blank of claim 20, wherein the top panel comprises at least one handle feature and the at least one central panel comprises a handle opening.

22. The blank of claim 21, wherein the at least one handle feature comprises a first handle feature and a second handle feature, and the handle opening comprises a first handle opening and a second handle opening.

23. The blank of claim 20, wherein the plurality of panels further comprises a side panel.

24. The blank of claim 23, wherein the side panel is a front side panel foldably connected to the front attachment panel, and the plurality of panels further comprises a back side panel foldably connected to the back attachment panel.

25. The blank of claim 16, wherein at least one end flap is foldably connected to the at least one of the front attachment panel and the back attachment panel.

26. The blank of claim 25, wherein the at least one end flap is a first end flap, the blank further comprises a second end flap foldably connected to the at least one of the front attachment panel and the back attachment panel, and the blank further comprises a third end flap foldably connected to the at least one of the front attachment panel and the back attachment panel.

27. The blank of claim 16, wherein at least one of the front attachment panel and the back attachment panel comprises a plurality of openings for at least partially receiving respective containers of the plurality of containers in the carrier formed from the blank.

28. A method of forming a carrier for holding a plurality of containers, the method comprising:

obtaining a blank comprising a plurality of panels, the plurality of panels a front central panel foldably connected to a back central panel at a lateral fold line, a front attachment panel foldably connected to the front central panel, and a back attachment panel foldably connected to the back central panel, each of the front central panel and the back central panel comprising an opening and each of the front attachment panel and the back attachment panel being configured to receive a portion of one or more containers of the plurality of containers, the opening in the front central panel is spaced a first longitudinal distance from the lateral fold line, the opening in the back central panel is spaced a second longitudinal distance from the lateral fold line, the first longitudinal distance is greater than the second longitudinal distance;

folding the plurality of panels such that each of the front central panel and the back central panel is positioned between adjacent containers of the plurality of containers and such that the opening of each of the front central panel and the back central is positioned in communication with the respective other of the front central panel and the back central panel so that the opening in the front central panel is offset from the opening in the back central panel; and attaching at least one of the front central panel and the back central panel to at least one container of the plurality of containers.

29. The method of claim 28, wherein at least one of the front central panel and the back central panel is adhered to adjacent containers of the plurality of containers.

30. The method of claim 28, wherein a face of the front central panel is in at least partial face-to-face contact with a face of the back central panel.

31. The method of claim 28, wherein at least one of the front attachment panel and the back attachment panel comprises a plurality of cuts that define edges for engaging respective containers of the plurality of containers.

32. The method of claim 31, wherein the plurality of cuts defines a respective plurality of container retention tabs.

33. The method of claim 31, wherein the plurality of cuts are for receiving at least a portion of respective containers of the plurality of containers therethrough.

34. The method of claim 28, wherein the plurality of panels further comprises a top panel overlying at least a portion of the at least one attachment panel.

35. The method of claim 34, wherein the top panel comprises at least one handle feature and the at least one central panel comprises a handle opening, the at least one handle feature of the top panel is aligned with the handle opening.

36. The method of claim 35, wherein the at least one handle feature comprises a first handle feature and a second handle feature, and the handle opening comprises a first handle opening and a second handle opening.

37. The method of claim 34, wherein the plurality of panels further comprises a side panel.

38. The method of claim 37, wherein the side panel is a front side panel foldably connected to the front attachment panel, and the plurality of panels further comprises a back side panel foldably connected to the back attachment panel.

39. The method of claim 28, wherein at least one end flap is foldably connected to at least one of the front attachment panel and the back attachment panel.

40. The method of claim 39, wherein the at least one end flap is folded downwardly relative to the at least one of the front attachment panel and the back attachment panel to overlie a portion of a container of the plurality of containers.

41. The method of claim 40, wherein the at least one end flap is a first end flap, the carrier further comprises a second end flap foldably connected to the at least one of the front attachment panel and the back attachment panel and folded downwardly relative to the at least one of the front attachment panel and the back attachment panel to overlie a portion of the container of the plurality of containers, and the carrier further comprises a third end flap foldably connected to and at least partially overlying a portion of the at least one of the front attachment panel and the back attachment panel.

42. The method of claim 28, wherein at least one of the front attachment panel and the back attachment panel comprises a plurality of openings for at least partially receiving respective containers of the plurality of containers.

43. A package, comprising:

a plurality of containers; and a carrier comprising:

a plurality of panels comprising a front central panel foldably connected to a back central panel at a lateral fold line, a front attachment panel foldably connected to the front central panel, and a back attachment panel foldably connected to the back central panel, a portion of one or more containers of the plurality of containers is received in the front attachment panel and the back attachment panel, each of the front central panel and the back central panel is positioned between and attached to adjacent containers of the plurality of containers, and each of the front central panel and the back central panel comprises an opening in communication with the respective other of the front central panel and the back central panel, the opening in the front central panel is spaced a first longitudinal distance from the fold line, the opening in the back central panel is spaced a second longitudinal distance from the fold line, the first longitudinal distance is greater than the second longitudinal distance such that the opening in the front central panel is offset from the opening in the back central panel.

44. The package of claim 43, wherein at least one of the front central panel and the back central panel is adhered to adjacent containers of the plurality of containers.

45. The package of claim 43, wherein a face of the front central panel is in at least partial face-to-face contact with a face of the back central panel.

46. The package of claim 43, wherein at least one of the front attachment panel and the back attachment panel comprises a plurality of cuts that define edges engaged with respective containers of the plurality of containers.

47. The package of claim 46, wherein the plurality of cuts defines a respective plurality of container retention tabs.

48. The package of claim 46, wherein the plurality of cuts receive at least a portion of respective containers of the plurality of containers therethrough.

49. The package of claim 43, wherein at least one end flap is foldably connected to at least one of the front attachment panel and the back attachment panel.

50. The package of claim 49, wherein the at least one end flap is folded downwardly relative to the at least one of the front attachment panel and the back attachment panel and overlying a portion of a container of the plurality of containers.

51. The package of claim 50, wherein the at least one end flap is a first end flap, the carrier further comprises a second end flap foldably connected to the at least one of the front attachment panel and the back attachment panel and folded downwardly relative to the at least one of the front attachment panel and the back attachment panel and overlying a portion of the container of the plurality of containers, and the carrier further comprises a third end flap foldably connected to and at least partially overlying a portion of the at least one of the front attachment panel and the back attachment panel.

52. The package of claim 43, wherein at least one of the front attachment panel and the back attachment panel comprises a plurality of openings at least partially receiving respective containers of the plurality of containers.

53. A package, comprising:

a plurality of containers; and a carrier comprising:

a plurality of panels comprising a front central panel foldably connected to a back central panel, a front attachment panel foldably connected to the front central panel, and a back attachment panel foldably connected to the back central panel, a portion of one or more containers of the plurality of containers is received in the front attachment panel and the back attachment panel, each of the front central panel and the back central panel is positioned between and attached to adjacent containers of the plurality of containers, and each of the front central panel and the back central panel comprises an opening in communication with the respective other of the front central panel and the back central panel and the opening in the front central panel is offset from the opening in the back central panel, wherein the plurality of panels further comprises a top panel overlying at least a portion of at least one of the front attachment panel and the back attachment panel.

54. The package of claim 53, wherein the top panel comprises at least one handle feature and the at least one of the front central panel and the back central panel comprises a handle opening, the at least one handle feature of the top panel is aligned with the handle opening.

55. The package of claim 54, wherein the at least one handle feature comprises a first handle feature and a second handle feature, and the handle opening comprises a first handle opening and a second handle opening.

56. The package of claim 53, wherein the plurality of panels further comprises a side panel.

57. The package of claim 56, wherein the side panel is a front side panel foldably connected to the front attachment panel, and the plurality of panels further comprises a back side panel foldably connected to the back attachment panel.

* * * * *